US009028618B2

(12) United States Patent
Battaglioli et al.

(10) Patent No.: US 9,028,618 B2
(45) Date of Patent: May 12, 2015

(54) STAGED COMPRESSOR WATER WASH SYSTEM

(71) Applicant: Gas Turbine Efficiency Sweden AB, Jarfalla (SE)

(72) Inventors: John L. Battaglioli, Ballston Lake, NY (US); Robert J. L. Bland, Oviedo, FL (US); Robert J. Burke, West Charlton, NY (US); Lindsay A. Early, Mechanicville, NY (US); Jonathan R. Knaust, North Syracuse, NY (US); Christopher R. Oliveri, Orlando, FL (US); Hilbert H. Valdez, Orlando, FL (US); Thomas Wagner, Troy, NY (US); Daniel F. Woolley, Schenectady, NY (US)

(73) Assignee: Gas Turbine Efficiency Sweden AB, Jarfalla (SE)

( * ) Notice: Subject to any disclaimer, the term of this patent is extended or adjusted under 35 U.S.C. 154(b) by 0 days.

(21) Appl. No.: 13/660,400

(22) Filed: Oct. 25, 2012

(65) Prior Publication Data

US 2013/0074879 A1 Mar. 28, 2013

Related U.S. Application Data

(62) Division of application No. 12/850,440, filed on Aug. 4, 2010.

(60) Provisional application No. 61/235,895, filed on Aug. 21, 2009.

(51) Int. Cl.
*B08B 3/02* (2006.01)
*B08B 9/00* (2006.01)
(Continued)

(52) U.S. Cl.
CPC ... *B08B 3/02* (2013.01); *B08B 9/00* (2013.01); *F01D 25/002* (2013.01); *F04D 29/705* (2013.01)

(58) Field of Classification Search
CPC ..... B08B 3/02; B08B 9/00; F01D 25/002; F04D 29/705
USPC ..... 134/22.1, 22.11, 22.12, 166 R, 198, 18, 134/22.18, 56 R, 168 R, 169 R, 171
See application file for complete search history.

(56) References Cited

U.S. PATENT DOCUMENTS 3,033,711 A * 5/1962 Harding ..... 134/7
3,623,668 A 11/1971 Fried
(Continued)

FOREIGN PATENT DOCUMENTS

AR 049056 A1 6/2006
DE 10254721 A1 * 6/2004 ..... F01D 25/12
(Continued)

OTHER PUBLICATIONS

DE 10254721—Machine Translation, Jun. 2004.*
(Continued)

*Primary Examiner* — Michael Kornakov
*Assistant Examiner* — Marc Lorenzi
(74) *Attorney, Agent, or Firm* — DLA Piper LLP (US)

(57) ABSTRACT

A compressor wash system for compressor washing includes stages of fluid delivery lines coupled at one end to a pump output and at the other end to a corresponding nozzle set. A control valve is connected to the fluid delivery line between the pump and the nozzle set, selectively supplying fluid between the pump and the nozzle set. Each nozzle of a nozzle set is positioned on an inlet of the compressor to allow the stages to wash a portion of the compressor. Nozzle sets are positioned around a bellmouth assembly and/or around an inlet cone of the compressor inlet, with a nozzle spray tip of each nozzle extending into an inlet air flow path of the compressor. Fluid may be directed to one or more of the stages in a sequencing pattern determined and configured to wash the compressor. Templates and installation guides are utilized to position the nozzles.

15 Claims, 37 Drawing Sheets

(51) Int. Cl.

| | |
|---|---|
| ***F01D 25/00*** | (2006.01) |
| ***F04D 29/70*** | (2006.01) |

(56) References Cited

U.S. PATENT DOCUMENTS

| | | | | |
|---|---|---|---|---|
| 3,795,983 | A * | 3/1974 | Gallagher et al. | 33/666 |
| 4,196,020 | A | 4/1980 | Hornak et al. | |
| 4,808,235 | A | 2/1989 | Woodson et al. | |
| 5,193,976 | A * | 3/1993 | Kolev et al. | 415/116 |
| 5,273,395 | A | 12/1993 | McDermott | |
| 5,385,014 | A | 1/1995 | Rathbun | |
| 5,385,609 | A | 1/1995 | Rose et al. | |
| 5,447,140 | A | 9/1995 | Brisbane et al. | |
| 5,868,860 | A | 2/1999 | Asplund | |
| 6,012,279 | A * | 1/2000 | Hines | 60/775 |
| 6,073,637 | A * | 6/2000 | Hayward et al. | 134/22.1 |
| 6,477,842 | B1 | 11/2002 | Nagata et al. | |
| 6,516,603 | B1 | 2/2003 | Urbach et al. | |
| 6,553,768 | B1 | 4/2003 | Trewin et al. | |
| 6,630,198 | B2 | 10/2003 | Ackerman et al. | |
| 7,185,663 | B2 | 3/2007 | Koch et al. | |
| 7,204,670 | B1 * | 4/2007 | Meher-Homji et al. | 415/1 |
| 7,353,654 | B2 * | 4/2008 | Bolis et al. | 60/775 |
| 7,445,677 | B1 | 11/2008 | Asplund | |
| 7,520,137 | B2 * | 4/2009 | Hoffmann et al. | 60/775 |
| 7,703,272 | B2 | 4/2010 | Wagner et al. | |
| 7,935,092 | B1 * | 5/2011 | Odland et al. | 604/272 |
| 2004/0028816 | A1 | 2/2004 | Ackerman et al. | |
| 2004/0069534 | A1 * | 4/2004 | Larsen et al. | 175/57 |
| 2005/0279101 | A1 * | 12/2005 | Hoffmann et al. | 60/775 |
| 2006/0048796 | A1 * | 3/2006 | Asplund et al. | 134/21 |
| 2006/0243308 | A1 * | 11/2006 | Asplund et al. | 134/22.12 |
| 2007/0000528 | A1 * | 1/2007 | Asplund et al. | 134/166 R |
| 2007/0028947 | A1 * | 2/2007 | Erickson et al. | 134/22.18 |
| 2007/0059159 | A1 | 3/2007 | Hjerpe | |
| 2008/0040872 | A1 * | 2/2008 | Hjerpe | 15/3 |
| 2008/0078422 | A1 * | 4/2008 | Wagner | 134/22.1 |
| 2008/0087300 | A1 | 4/2008 | Kohler et al. | |
| 2008/0087301 | A1 * | 4/2008 | Lee et al. | 134/18 |
| 2009/0320440 | A1 * | 12/2009 | Erickson et al. | 60/39.53 |
| 2010/0037924 | A1 | 2/2010 | Gebhardt et al. | |

FOREIGN PATENT DOCUMENTS

| | | | |
|---|---|---|---|
| EP | 0933502 | A2 | 8/1999 |
| EP | 1749976 | | 2/2007 |
| EP | 1903188 | | 3/2008 |
| EP | 2052792 | | 4/2008 |
| JP | 2007-40307 | | 2/2007 |
| JP | 2008-69778 | | 3/2008 |
| JP | 2008069778 | | 3/2008 |
| JP | 2009115079 | | 5/2009 |

OTHER PUBLICATIONS

"To Fog or not to Fog: What is the answer?", Special Issue: Outage Handbook, Power Augmentation, *Combined Cycle Journal*, Third Quarter, 2008, pp. 105-111.

Official Action issued May 29, 2013 in co-pending Argentine Patent Appln. No. P100103056.

Official Action issued Feb. 7, 2012 in co-pending Japanese Patent Appln. No. 2010-185201.

US Office Action dated Jun. 19, 2014.

Japanese Official Action dated Nov. 19, 2013 along with its English translation in corresponding Japanese Application No. 2012-172566.

Office Action dated Oct. 6, 2014 from related U.S. Appl. No. 12/850,440.

Notice of Allowance dated Dec. 11, 2014 from corresponding U.S. Appl. No. 12/850,440.

* cited by examiner

STAGED COMPRESSOR WATER WASH SYSTEM

CROSS-REFERENCE TO RELATED APPLICATIONS

This application is a divisional of U.S. application Ser. No. 12/850,440 filed Aug. 4, 2010, which claims priority to U.S. Provisional Patent Application No. 61/235,895, filed on Aug. 21, 2009, entitled "Staged Compressor Water Wash System," the subject matter of which is incorporated herein reference.

TECHNICAL FIELD

This disclosure relates generally to compressor wash systems. More specifically, this disclosure relates to a compressor staged wash system as well as associated systems and methods that support advanced functionality of such staged wash system and that broadly apply to other on wash systems.

BACKGROUND

Compressor wash systems pertain to cleaning a compressor air flow path. Due to the combination of large mass flow, dimensionally large inlet, large blades susceptible to erosion, and/or high compression ratios, cleaning the compressor while in operation has many difficulties.

In particular in gas turbine applications, large mass flow requires a large fluid or fluid flow for proper cleaning, which can cause flame out on combustion systems, such as a low NOx PPM combustion system. A large inlet requires multiple and possibly many water injection points to properly cover the rotating and non-rotation blades. Cleaning of the particles off the blades while balancing the effects of erosion may require a wide range of fluid droplet sizes for systematically different amounts of time. A high compression ratio evaporates the water, making cleaning later stages not possible, thus placing more emphasis on cleaning the prior stages. Moreover, installations in the tick demand an easily repeatable procedure, and as many interference issues may exist, a rugged yet compact design is required.

High concentrations of is fluid, such as but not limited to water, aid in cleaning effectiveness. However, due to combustion instability that high concentrations of a fluid, such as water, may cause, there is a limit to the amount of a fluid that can be injected into the compressor. To mitigate the issue of high concentrations of a fluid and flame out, multi-staging of the fluid injection points or nozzles may allow for cycling the nozzles for locally higher concentrations of fluid to air to be impinged on the stationary and rotating blades of the compressor for increased or maximum cleaning efficiency.

Industrial stationary compressor inlets may, for example, include an inlet filter housing, inlet cone, bellmouth casing, and inlet struts. The compressor may be used in various applications, including providing compressed air to industrial large frame gas turbines, and may also be used in the oil and gas industry for natural gas compressor applications, commercial power generation, such as oil and gas platforms, boats, or any other application in which compressors may be used. Nozzle placement for compressor cleaning may be subject to consideration for the particular application, such as, for example, various mass flow rates that affect the fluid water to air ratio and trajectory of the water flow.

At base load, the air inlet velocity may differ greatly by around 10 times at the first stages radially along the blades from compressor blade root to tip, with the lowest velocity near the blade root. Fluid, such as water, not injected directly in the high velocity areas have proven to be directed towards the blade root, resulting in concentrated erosion of the highest stressed part of the blade. Properly cleaning the blade tips for online washing requires line of sight, from nozzle injection point to blade tip, as well as being located in the high velocity region.

Large water droplets may typically have a much larger impact than smaller droplets on the blades, which aid in a higher leading edge erosion rate. The blade root is the highest stressed part of the blade, and leading edge erosion may be a problem. Keeping the area clean and erosion to a minimum requires the use of small droplets. Shorter blasts of large droplets typically aid in cleaning effectiveness but should be used sparingly if used at all.

For example, in a compressor wash system that includes a multi-stage manifold, opening all stages at once may reduce the manifold back pressure and thus increase the fluid droplet size. Fluctuating fluid droplet size between large and small may aid in cleaning effectiveness in two ways: (1) large droplets may reach further stages of the compressor as they may take longer time to evaporate as they travel downstream the compressor, and (2) for a consistent compressor mass flowrate, varying pressure and fluid droplet size may change the impact region of the water droplets.

Designing an effective online wash with adequate compressor intake throat coverage may require nozzle installations in a geometrically difficult area due to casting thickness, curvature, access, and interferences, while maintaining a rugged design capable of withstanding an industrial environment.

Thus, an effective and efficient compressor wash system that addresses these needs and constraints, as well as others, is desired.

SUMMARY

A compressor wash system for washing a compressor includes, according to an embodiment, a pump for supplying fluid, fluid delivery lines connected at one end to an output of the pump, and nozzle sets that each correspond to a respective fluid delivery line and that are connected at an opposite end of the respective fluid delivery line. Each nozzle set includes one or more nozzles. Moreover, each nozzle is positioned in an opening on an inlet of the compressor or on an inlet cone of the compressor, with the nozzle extending into an inlet air flow path of the compressor within the line of sight of compressor blades. The compressor wash system also include a control valve for selectively supplying fluid from the pump, each connected to a corresponding fluid delivery line between the pump and corresponding nozzle set.

A compressor wash system for washing a compressor, according to another embodiment, includes multiple stages, each comprised of a fluid delivery line that is connected at one end to a pump output and at the other end to a nozzle set. Each stage also includes a control valve that is connected to the fluid delivery line between the pump and the nozzle set and that is configured to selectively supply fluid between the pump and the nozzle set. The nozzle sets include nozzles having a nozzle body and a nozzle spray tip at the end of the nozzle body. Each nozzle of the various stages is positioned on an inlet of the compressor to allow each of the plurality of stages to wash a different portion of the compressor.

A method for washing a compressor, according to an embodiment, includes providing nozzle sets that each include one or more nozzles. Templates and/or installation guides are applied to a portion of an inlet of the compressor to mark a location for the nozzles, and the nozzles are then accordingly positioned on the inlet of the compressor at the corresponding marked locations. The positioning includes positioning the nozzles so that the nozzles extend into an inlet air flow path of the compressor within the line of sight of compressor blades. The nozzle sets are connected at an output of a pump via a corresponding fluid delivery line, and fluid is selectively supplied from the pump to one or more of the nozzle sets, the selective supply being based upon a predetermined sequencing pattern for washing a desired portion of the compressor.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing summary and the following detailed description are better understood when read in conjunction with the appended drawings. Exemplary embodiments are shown in the drawings, however, it is understood that the embodiments are not limited to the specific methods and instrumentalities depicted herein. In the drawings.

DETAILED DESCRIPTION

Figure 1:
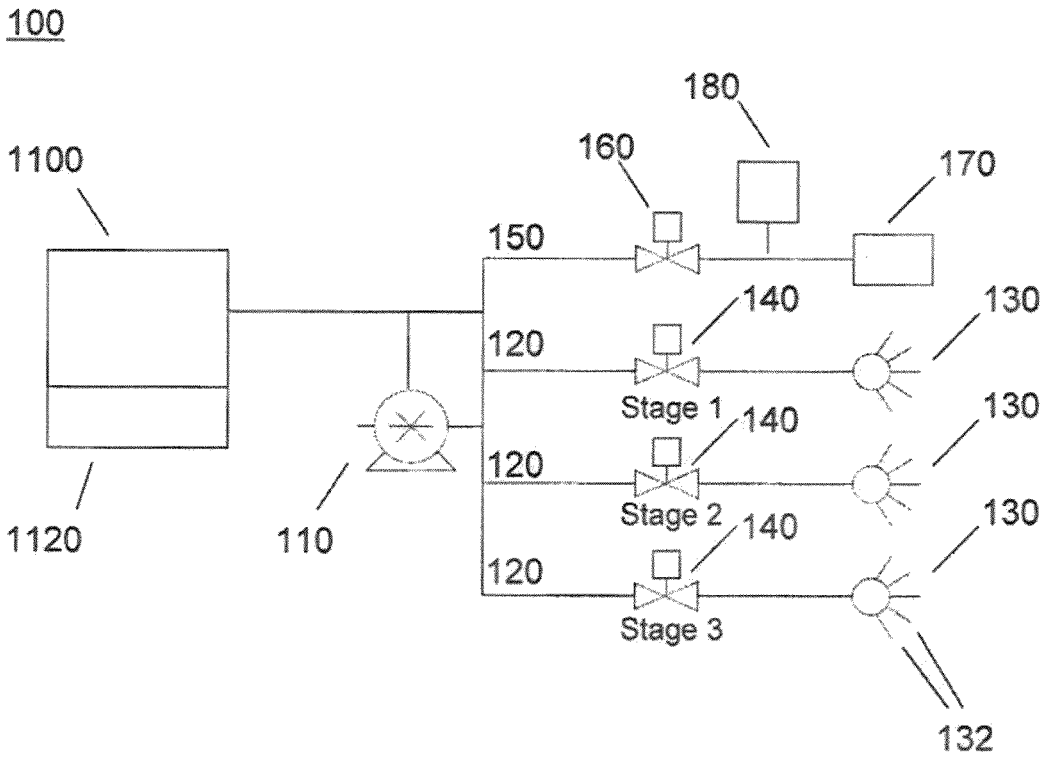
FIG. 1 illustrates a compressor wash system, including piping and instrumentation, according to an embodiment.

As used herein, the following terms have the indicated meanings:

"Additive" means any gas, liquid or solid of a molecule, chemical, macromolecule, compound, or element, alone or in combination added in any amount to something else.

"Alloy" means a substance composed of two or more metals, or of a metal or metals with a non-metal.

"Anti-corrosive" means having an ability to decrease the rate of, prevent, reverse, stop, or a combination thereof, corrosion.

"Base Load" may refer to, but is not limited to, the maximum output a specific as turbine engine may produce at any given pressure, temperature, altitude or other atmospheric condition.

"Bellmouth" refers to a flared opening on an inlet compressor.

"Connect" means to join, link, couple, attach, or fasten together two or more components. "Connected" means, with two or more components that are joined, linked, coupled, attached, or fastened together. "Connectors" means a component used to join, couple, attach, or fasten together one or more components. "Connection" means a state of two or more component joined, linked, coupled, attached, or fastened together.

"Compressor Blade" means rotating or non-rotating blades including but not limited to inlet guide vanes (IGVs), variable IGVs, stator blades or other vanes or blades associated with a compressor.

"Contamination" means the presence of foreign materials, including but not limited to microorganisms, chemicals, or a combination thereof.

"Corrosion" means a state of at least partial damage, deterioration, destruction, breaking down, alteration, or a combination thereof.

"Erosion" means a state of at least partial degradation, wearing away, removal of a material, or a combination thereof.

"Fastened" or "Fasten" means, with respect to two or more components that are attached to each other, attached in any manner including but not limited to attachment by one or more bolts, screws, nuts, pins, stitches, staples, brads, rivets, adhesives, straps, attaching by tack welding, bracing, strapping, welding, or using a fitting, or a combination thereof.

"Fluid" means any substance that may be caused to flow, including but not limited to a liquid or gas or slurry, or a combination thereof. "Fluid" may include but is not limited to water, steam, chemical compounds, additives or a combination thereof. A fluid may have one or more solid particles therein.

"IGV" means inlet guide vanes.

"LAF" means looking against flow.

"LAR" means liquid to air ratio.

"Liquid" may include but is not limited to water, chemical compounds, additives, or anything that has no fixed shape but has a characteristic readiness to flow, or a combination thereof. A liquid may have one or more solid particles therein.

"LWF" means looking with flow.

"Metal" means having at least one of any of a class of elementary substances which are at least partially crystalline when solid. "Metal" may include but is not limited to gold, silver, copper, iron, steel, stainless steel, brass, nickel, zinc, aluminum, or a combination thereof, including but not limited to an alloy.

"Staged" or "Stage" means sequentially turning on different zones or modes of a wash system at discrete and/or simultaneous time periods.

With reference to FIGS. 1, 6, 7*b* and 11-12, a compressor wash system 100 for washing a compressor, according to an embodiment, is illustrated. The compressor wash system 100 may include a pump 110, a plurality of fluid delivery lines 120, a plurality of nozzle sets 130, and a plurality of control valves 140.

The pump 110 is configured to supply fluid and may be, for example, a positive displacement pump ranging at a flow rate between 0.5 GPM and 80 GPM with operating pressure ranging from about 600 psi to about 1200 psi. Other flow rates and operating pressures may be suitable. Moreover, other types of pumps with various operating parameters may be employed in the compressor wash system 100, and the compressor wash system 100 is not limited to including a positive displacement pump.

The plurality of fluid delivery lines 120 may each be connected at one end to an output of the pump 110 to receive and deliver the fluid supplied by the pump 110. A nozzle set 130 may be connected at an opposite end of each fluid delivery line 120, so that each of the plurality of nozzle sets 130 corresponds to one of the plurality of fluid delivery lines 120. Each nozzle set 130 may include one or more nozzles 132, with each nozzle 132 including a nozzle body 134 and a nozzle spray tip 136 disposed on an end of the nozzle body 134 (see FIGS. 6, 11, and 12, for example). Thus, each fluid delivery line 120 may receive fluid from the pump 110 and deliver the fluid to a corresponding nozzle set 130, which may include one or more nozzles 132 for dispersing the fluid.

Each of the plurality of control valves 140 may be connected to a corresponding one of the plurality of fluid delivery lines 120 between the pump 110 and a corresponding nozzle set 130. In this manner, each fluid delivery line 120 may have a corresponding control valve 140 and a corresponding nozzle set 130. Each control valve 140 may be operable to selectively supply fluid from the pump 110 to a corresponding nozzle set 130 via a corresponding fluid delivery line 120. The control valves 140 may be, for example, high pressure control valves.

A corresponding fluid delivery line 120, control valve 140, and nozzle set 130 may be referred to as a stage. Thus, according to the embodiment illustrated in FIG. 1, the compressor wash system 100 has three stages (stage 1, stage 2, and stage 3), although the compressor wash system 100 is not limited thereto and may include more or less stages.

The compressor wash system 100 may also include a drain line 150, a drain control valve 160, and a drain 170. One end of the drain line 150 may be connected to an output of the pump 110, while the opposite end of the drain line 150 may be connected to a drain 170 or other component or area into which fluid in the drain line 150 is discharged. The drain control valve 160 may be connected to the drain line 150 between the pump 110 and the drain 170 and may be configured to selectively supply fluid from the pump 110 to the drain 170 or other discharge component or area.

A sensor 180 may also be connected in the drain line 150 to provide feedback to the compressor wash system 100 while washing a compressor. For example, in one embodiment, one or more conductivity sensors 180 may monitor the draining or effluent fluid for conductivity or for purity for determining a number of offline wash rinse cycles. Compressor wash rinse cycles may continue to run until a preset draining or effluent fluid purity level is measured by one or more conductivity sensors 180. In other embodiments, one or more sensors 180 may monitor other parameters, and compressor wash rinse cycles may continue to run until a variable or operator selected conductivity, purity level of drain fluid, amount of solid contents within drain fluid, or other parameter is measured by one or more of the sensors 180. The drain control valve 160 may supply fluid from the pump 110 to the drain 170 until a preset monitored value is reached.)

Figure 2A:
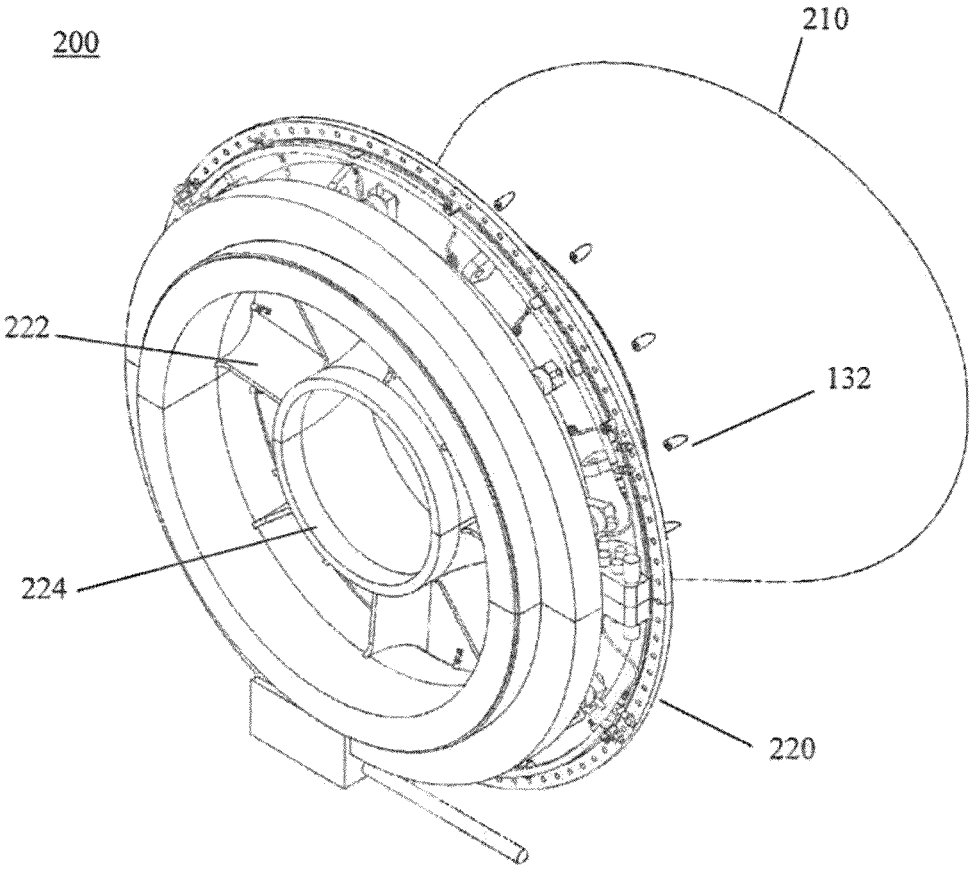
FIGS. 2*a* and 2*b* illustrate a compressor inlet with an inlet cone and a bellmouth assembly according to an embodiment.
Figure 2B:
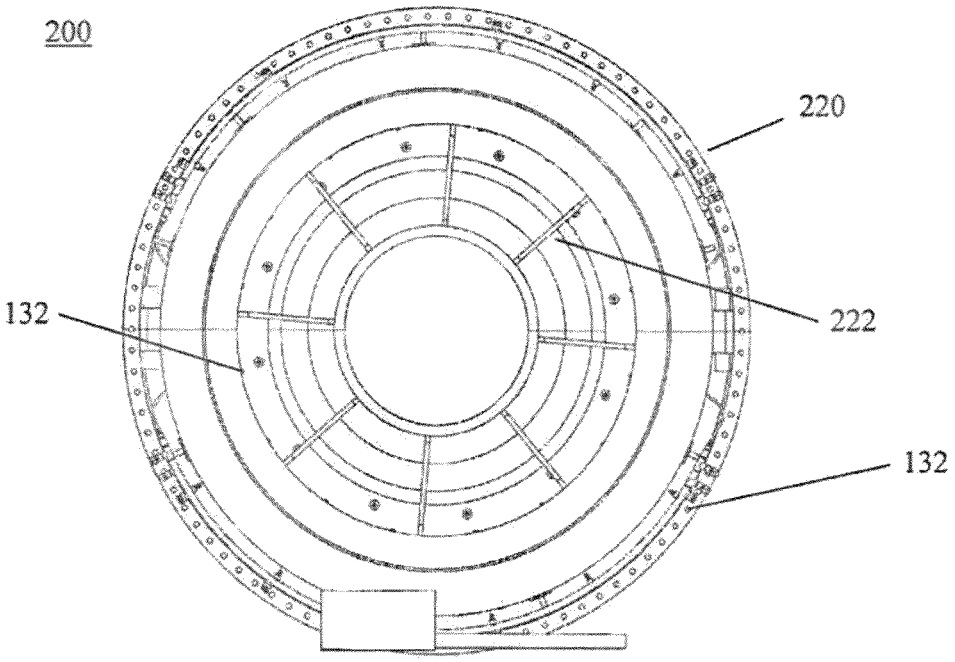
Figure 6:
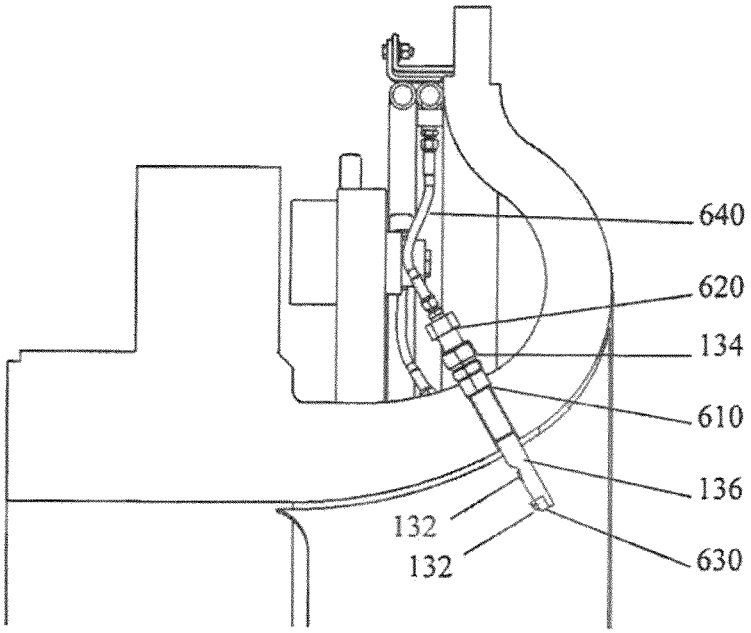
FIG. 6 represents a cross-sectional view of a bellmouth nozzle installation according to an embodiment.

With reference to FIGS. 2*a*-2*b* and 6, a compressor inlet 200 is illustrated. The compressor inlet 200 may include an inlet cone 210 and a bellmouth assembly 220. The bellmouth assembly 220 may include a bearing hub 224 and a plurality of struts 222. Each strut 222 may extend outward from the bearing hub 224 to the bellmouth assembly 220. FIG. 2*b* provides an aft view of the bellmouth assembly 220 against air flow.

Each nozzle 132 of the one or more nozzle sets 130 of the compressor wash system 100 may be positioned in or on a portion of the compressor inlet 200 to aid in a washing operation of the compressor. For example, according to an embodiment, each nozzle 132 may be positioned in an opening on the compressor inlet 200, such as on the inlet cone 210 and/or the bellmouth assembly 220. Each nozzle spray tip 136 may be positioned to extend into an inlet air flow path of the compressor inlet 200.

Figure 3:
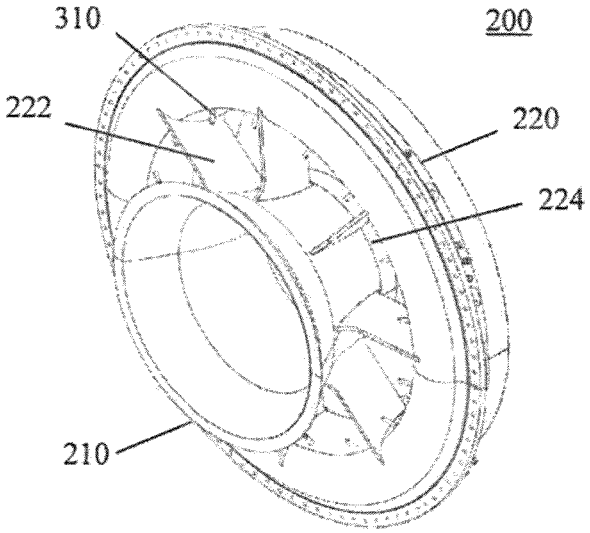
FIG. 3 illustrates nozzle placement in a bellmouth assembly according to an embodiment.

With reference to FIG. 3, nozzle placement in the bellmouth assembly 220 is illustrated. According to an embodiment, the nozzles 132 include two bellmouth nozzles 310 placed in between each of the struts 222. However, more or fewer bellmouth nozzles 310 may be placed in the bellmouth assembly 220. Moreover, the spaces between each of the struts 222 are not required to include the same number of bellmouth nozzles 310. According to an embodiment, the nozzle placement is with the line of sight of the compressor blades (not shown). The spray tips of the bellmouth nozzles 310 may extend up to as much as thirty percent into the inlet air flow path. However, in some embodiments the spray tips of the bellmouth nozzles 310 may extend up to fifty percent into the air flow path. The direction of the bellmouth nozzles 310 may be with the inlet air flow path. The bellmouth nozzle 310 body may be perpendicular to the bearing hub 224 or may range within ±20 degrees of the curvature face of the bellmouth assembly 220 in the air flow path. The bellmouth nozzle 310 may have an operating pressure range from about 600 to about 1200 psi and a fluid droplet size ranging from about 50 μm to about 500 μm with a deviation in the ninetieth percentile. Other suitable operating pressures and fluid droplet sizes may be utilized.

FIGS. 4*a*-4*f* illustrate spray patterns of nozzles 132 according to various embodiments.

Figure 4A:
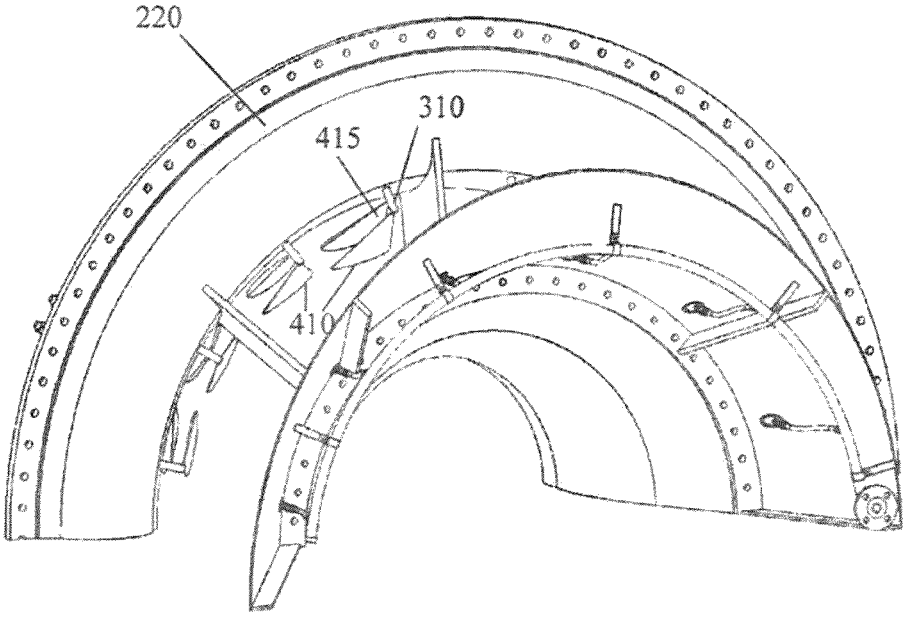
FIGS. 4*a*-4*f* illustrate spray patterns of bellmouth nozzles and inlet cone nozzles with respect to a compressor inlet according to various embodiments.

With reference to FIG. 4*a*, an online spray pattern of a bellmouth nozzle 310 (hereinafter a bellmouth spray pattern 410) is illustrated. The online, bellmouth spray pattern 410 may range from a flat fan shape to a cone shape. Two primary bellmouth nozzle spray angles 415 define the bellmouth spray pattern 410 shape and may range between 1° and 75° of the sprayed fluid discharge shape with compressor flow while the compressor is running, for example. The online wash is typically operated when a compressor discharge temperature is at or greater than the boiling point of water or a turbine is online, including but not limited to base load operation. A desired online spray pattern, such as the bellmouth spray pattern 410 or other suitable spray pattern, may be utilized wherein complete, near complete, or adequate coverage of the compressor blades (not shown) is achieved so that the bellmouth spray pattern 410 encompasses the compressor blades' leading edge tip to the compressor blades' midspan, circumferentially and radially.

Some embodiments may include an offline spray pattern of a bellmouth nozzle 310. The offline bellmouth spray pattern 410 may range from a flat fan shape to a cone shape. Two primary bellmouth spray angles 415 define the bellmouth spray pattern 410 shape and may range between 1° and 75° of the spayed fluid discharge with compressor flow, for example. The offline wash is typically operated when a compressor discharge temperature is less than the boiling point of water or a turbine is offline. In some embodiments, an offline wash operates while the turbine is offline and at part speed. A desired offline spray pattern, such as the offline bellmouth spray pattern 410 or other suitable spray pattern, may be utilized wherein complete, near complete, or adequate coverage of the compressor blades (not shown) is achieved so that the offline bellmouth spray pattern 410 encompasses the compressor blades' leading edge tip to the compressor blades' midspan, circumferentially and radially.

Figure 4B:
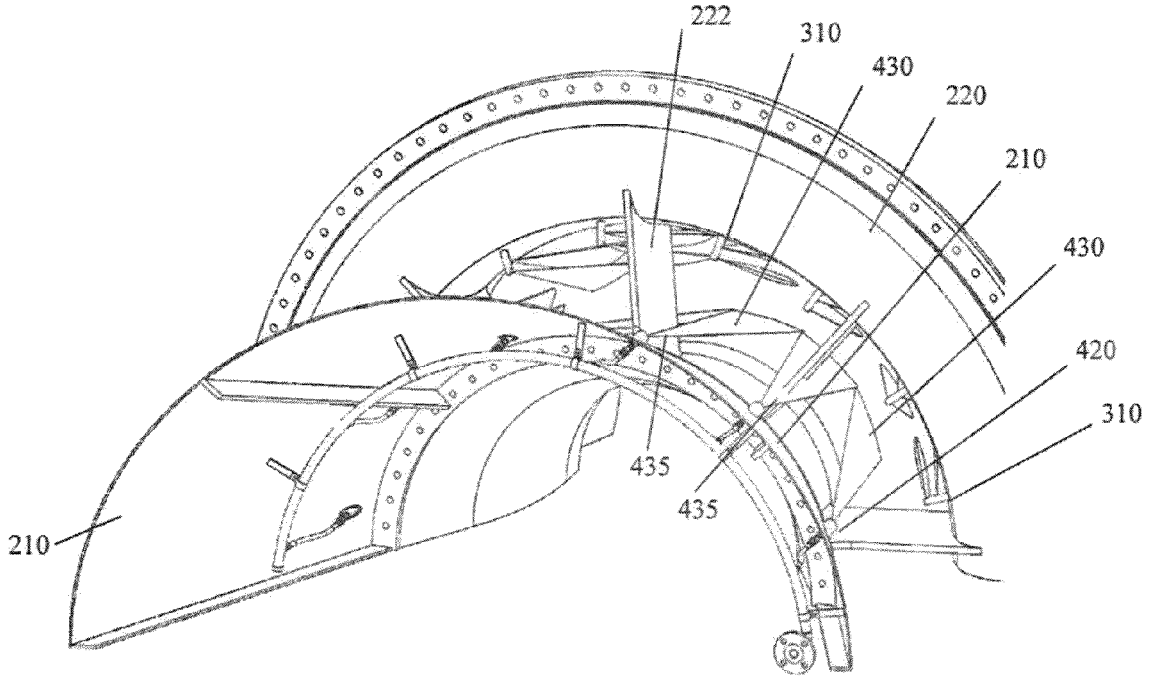

With reference to FIG. 4*b*, inlet cone nozzles 420 and their placement thereof, with respect to the compressor inlet 200 and the inlet cone 210, are illustrated. According to an embodiment, the inlet cone nozzles 420 may be positioned around the circumference of the inlet cone 210 such that the spray tips of the inlet cone nozzles 420 are pointed mid-span at the compressor blade leading edge and such that the nozzle bodies of the inlet cone nozzles 420 are parallel with a compressor rotor centerline with a range between ±20°. Other suitable ranges may be used. The inlet cone nozzle 420 direction may be with the inlet air flow path and may be with the line of sight of the compressor blades. The, inlet cone nozzle 420 spray tips may extend up to five percent into the inlet air flow path. However, in some embodiments, the inlet cone nozzle 420 spray tip may extend further into the air flow path, such as, for example, up to twenty percent into the air flow path. The inlet cone nozzle 420 operating pressure range may be between about 600 and about 1200 psi with a droplet ranging from about 50 μm to about 500 μm with a deviation in the ninetieth percentile. Other suitable operating pressure ranges and fluid droplet sizes may be utilized.

With further reference to FIG. 4*b*, an online spray pattern of an inlet cone nozzle 420 (hereinafter inlet cone spray pattern 430) is illustrated. The online, inlet cone spray pattern 430 may range from a flat fan shape to a cone shape. Two primary inlet cone spray angles 435 define the inlet cone spray pattern 430 and may range between 1° and 60° of the sprayed fluid discharge shape with compressor flow in an atmospheric condition while the compressor is running, for example. The online wash is typically operated when a compressor discharge temperature is at or greater than the boiling point of water or a turbine is online, including but not limited to base load operation. A desired online spray pattern, such as the inlet cone spray pattern 430 or other suitable spray pattern, may be utilized in which complete, near complete, or adequate coverage of the compressor blades (not shown) when a compressor or turbine is online is achieved so that the inlet cone spray pattern 430 encompasses the compressor blades' root to the compressor blades' midspan, circumferentially and radially.

Some embodiments include an offline inlet cone spray pattern 430 of an inlet cone nozzle 420. The offline, inlet cone spray pattern 430 may be of a flat fan shape or cone shape. Two primary inlet cone spray angles 435 define an inlet cone spray pattern 430 and may range between 1° and 75° of the sprayed fluid discharge with compressor flow, for example. The offline wash is typically operated when a compressor discharge temperature is less than the boiling point of water or a turbine is offline. In some embodiments, an offline wash operates while the turbine is offline and at part speed. A desired spray pattern, such as the offline inlet cone spray pattern 430 or other suitable spray pattern, may be utilized in which complete, near complete, or adequate coverage of the compressor blades (not shown) is achieved so that the offline inlet cone spray pattern 430 encompasses the compressor blades' root to the compressor blades' midspan, circumferentially and radially.

In other embodiments, a spray pattern may encompass, cover or spray different targeted areas on the compressor blades in a radial or circumferential direction. For example, a bellmouth spray pattern 410 may target to encompass the compressor blade leading edge tip to a percentage of radial coverage of the compressor blade, with a targeted spray overlap of an inlet cone spray pattern 430 (i.e., the percentage of radial coverage of the compressor blade may be more or less than the compressor blade midspan). An inlet cone spray pattern 430 may also target to encompass the compressor blade root to a certain percentage of radial coverage of the compressor blades.

Figure 4C:
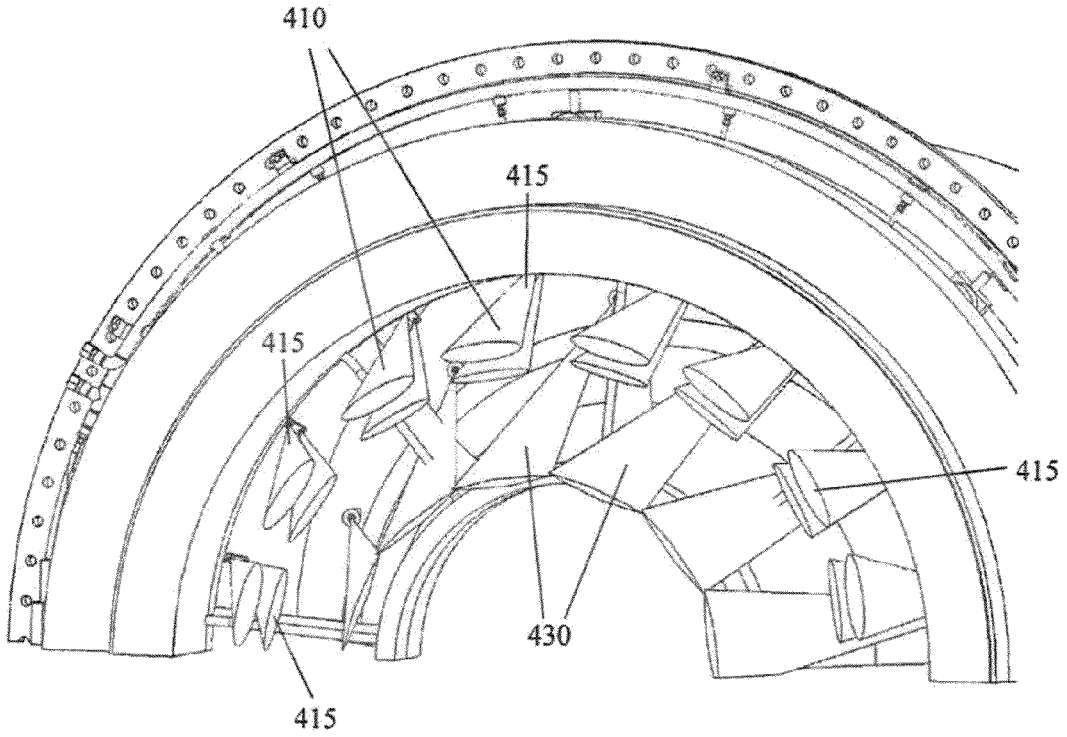
Figure 4D:
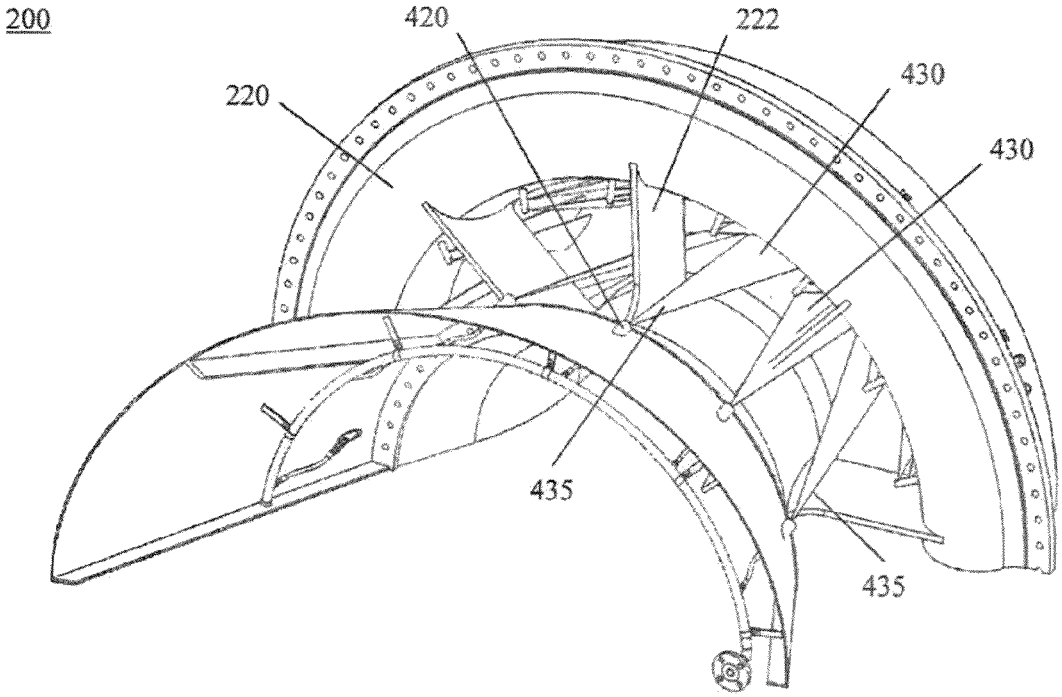
Figure 4E:
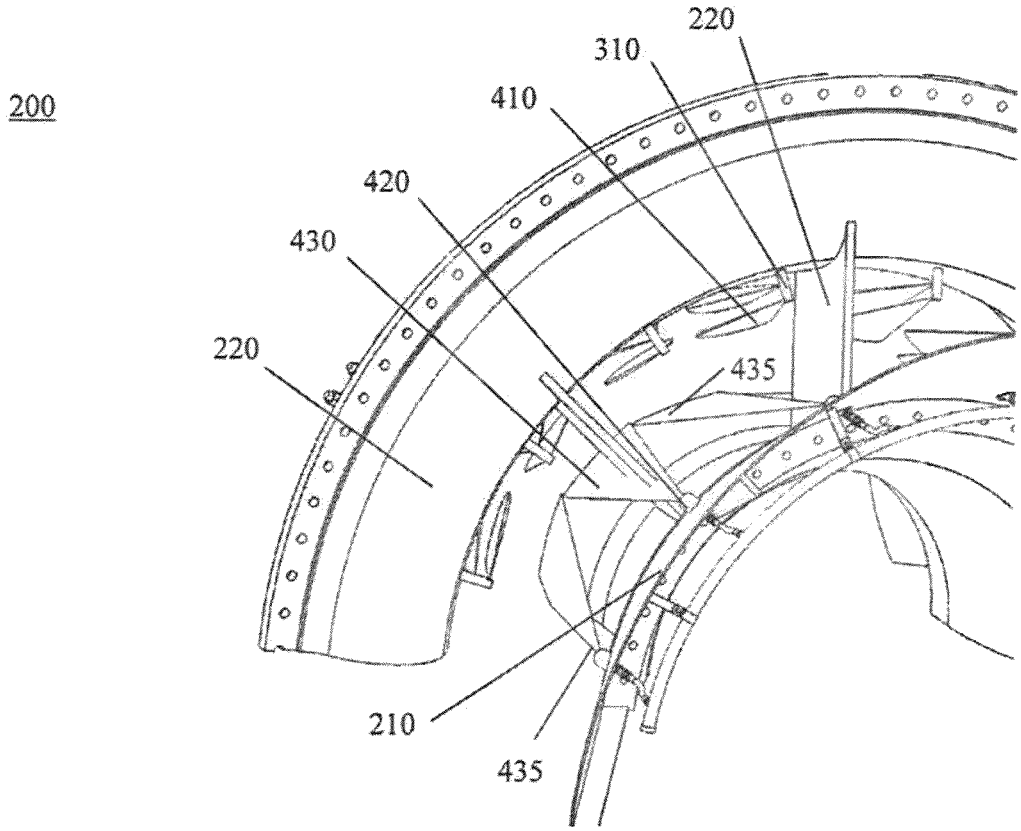
Figure 4F:
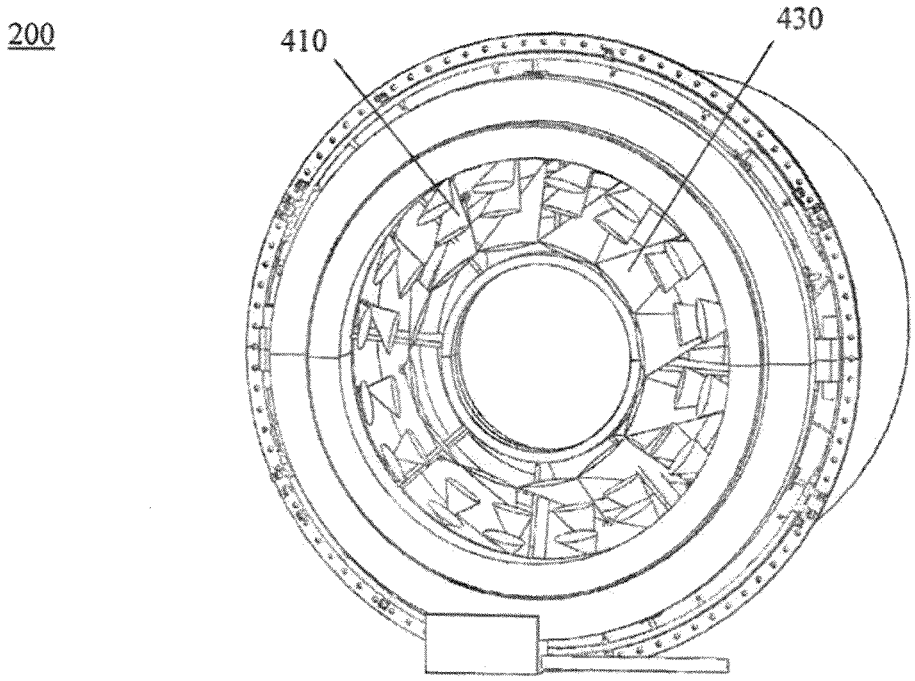

FIG. 4*c* illustrates an embodiment of an offline spray pattern that includes a bellmouth spray pattern 410, a bellmouth spray angle 415 and an inlet cone spray pattern 430. FIGS. 4*d* and 4*e* illustrate, in a direction of airflow, an online spray pattern of a compressor inlet 200, including a bellmouth spray pattern 410, an inlet cone spray pattern 430, and an inlet cone spray angle 435; while FIG. 4*f* illustrates, in a direction against airflow, an online spray pattern that also includes a bellmouth spray pattern 410 and an inlet cone spray pattern 430.

Figure 5:
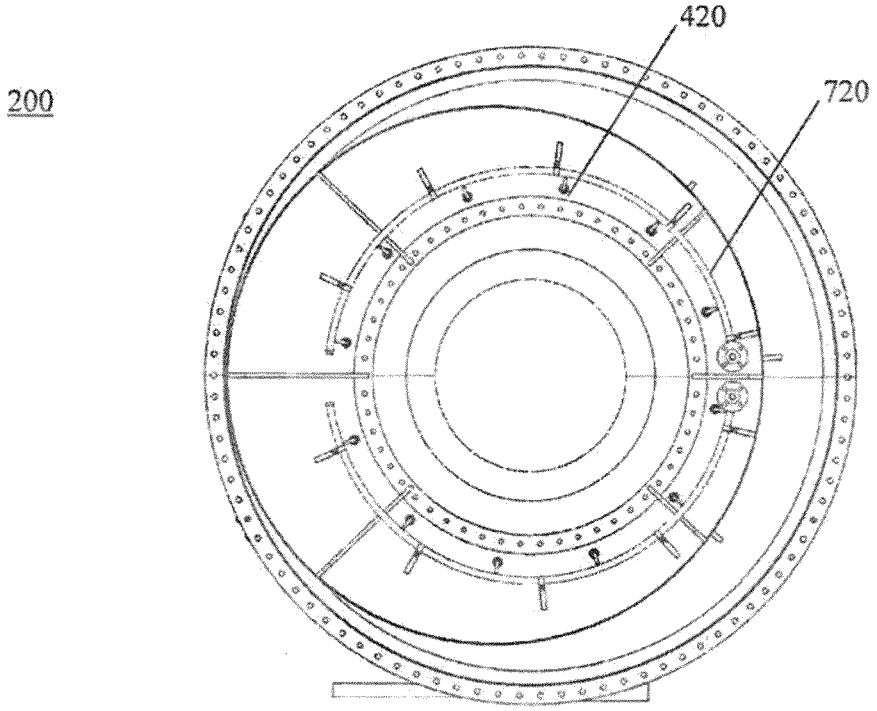
FIG. 5 illustrates a cone nozzle assembly in a direction of air flow according to an embodiment.

FIGS. 4*d* and 5 illustrate a compressor inlet 200 in a direction of air flow, according to an embodiment. Inlet cone nozzles 420 may be, according to an embodiment, spared evenly every 30°. Any number of inlet cone nozzles 420 and/or spacing thereof may be utilized to obtain complete, near complete, or desired coverage of the compressor inlet compressor blades, while a turbine is offline or online, or when a compressor discharge temperature is above or below the boiling point of water, so that an inlet cone spray pattern 430 or other suitable spray pattern encompasses the compressor blade's root to the compressor blade's midspan, circumferentially and/or radially.

Figure 8A:
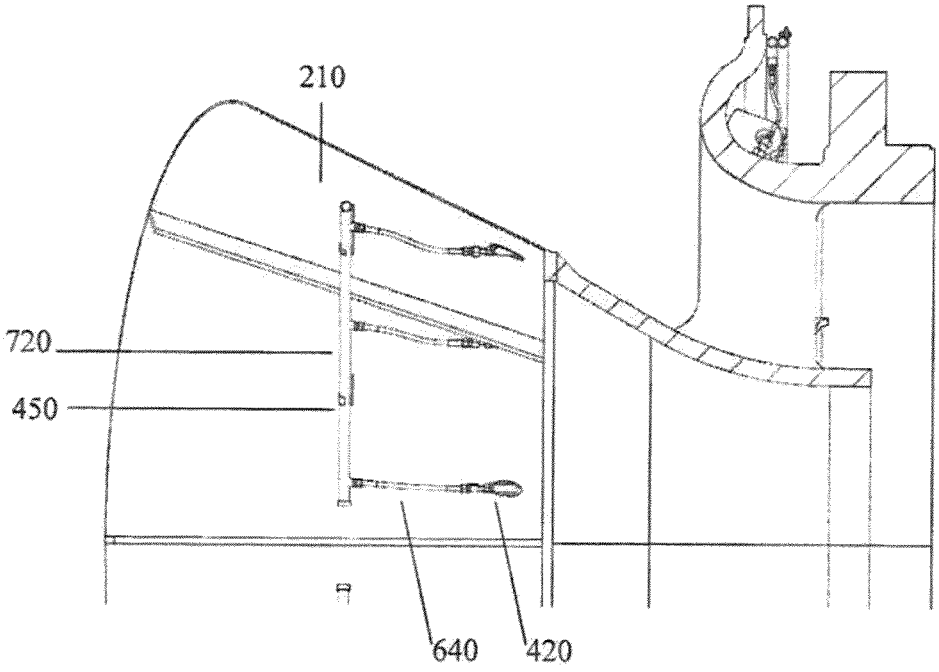
FIGS. 8*a*-8*d* represent cross-sectional views of portions of a bellmouth assembly and an inlet cone according to embodiments.
Figure 8B:
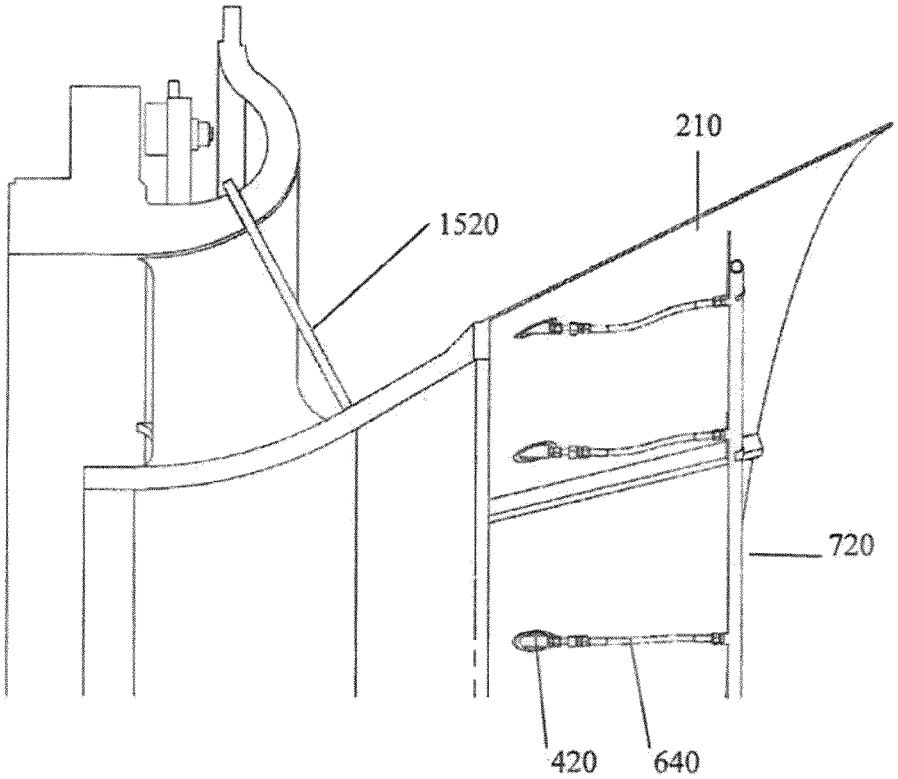
Figure 8C:
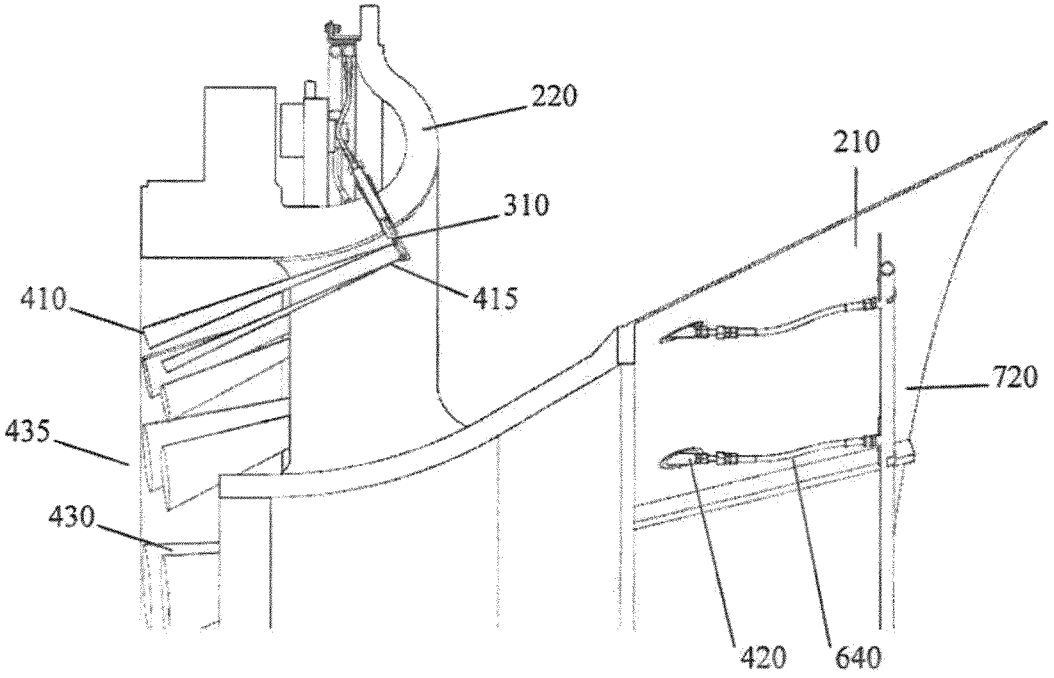
Figure 8D:
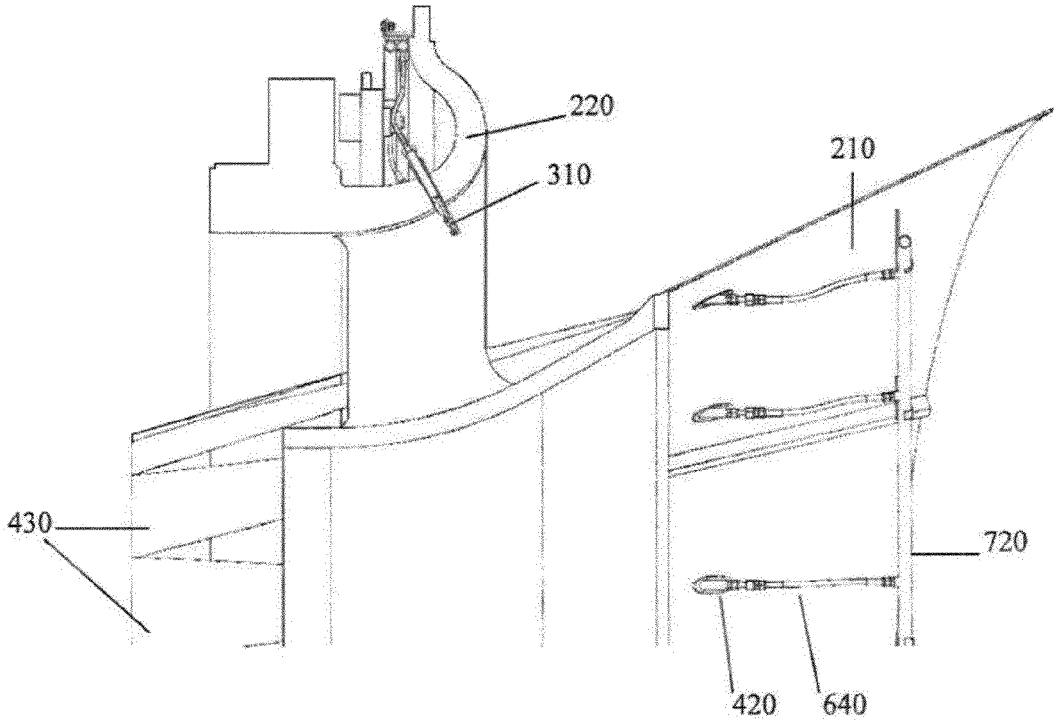

FIGS. 6, 8*c* and 8*d* represent a cross-sectional view of an installation of a bellmouth nozzle 310 or inlet cone nozzle 420. According to an embodiment, a nozzle body 134, such as that of a bellmouth nozzle 310 or inlet cone nozzle 420, may be installed from an external portion of a compressor inlet 200 and locked or otherwise secured in place with a threaded compression fitting sleeve 610. A lock collar 620 may be part of the solid one-piece nozzle body 134, according to an embodiment, to secure the nozzle 132 and to prevent or assist in preventing the nozzle 132 or nozzle body 134 from sliding through the compression fitting sleeve 610 and into an undesired portion of the inlet air flow path. A flat surface 630 may, according to an embodiment, be machined into a head of the nozzle body 134 to allow for an adjustable wrench or other equipment to hold and align the nozzle spray tip 136 during installation. Of course, other suitable materials and methods may be used to secure or fasten the nozzle 132 or nozzle body 134 in the inlet air flow path, or prevent or assist in preventing the nozzle 132 or nozzle body 134 from sliding into an undesired portion of the inlet, air flow path.

According to an embodiment, a solid one-piece nozzle body 134 may be threaded into a welded standoff in which the solid one-piece nozzle body 134 flares out to a lock collar to prevent a compressor wash nozzle 132 or nozzle body 134 from entering into an undesired portion of the inlet air flow path.

Figure 7A:
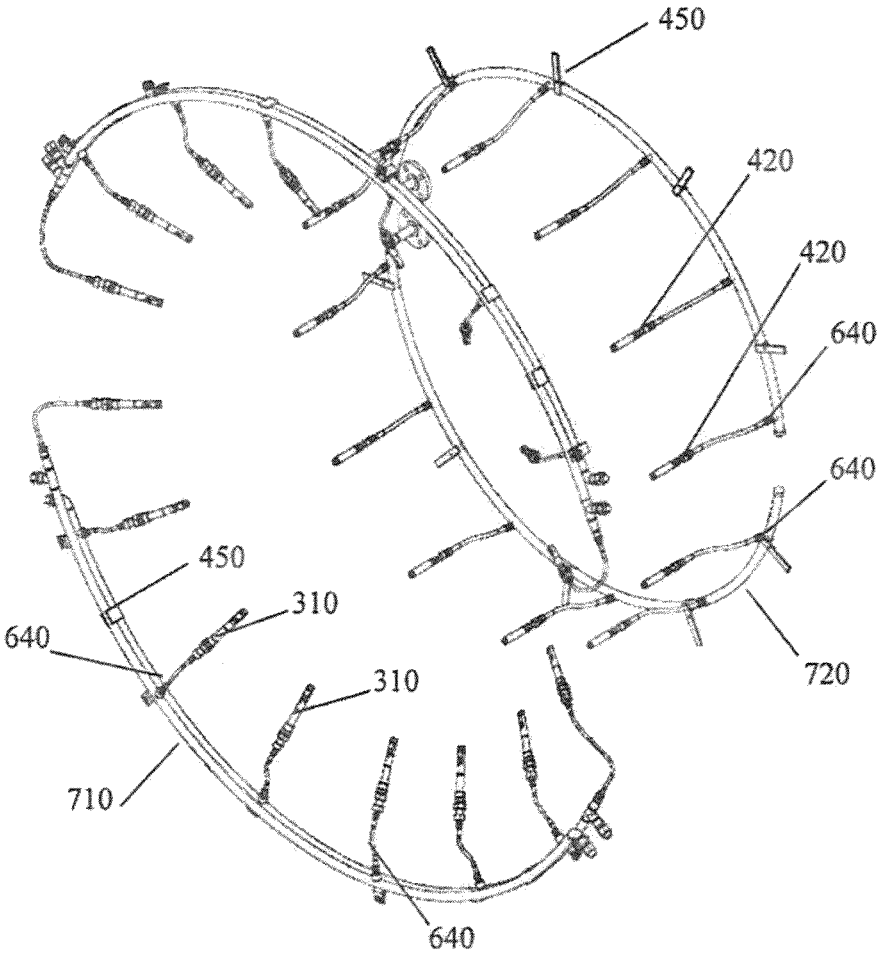
FIG. 7*a* illustrates a compressor wash system that includes two or more manifold assemblies according to an embodiment.

FIG. 7*a* represents an embodiment of a compressor wash system 100 that includes two or more manifolds, where at least one manifold is for the inlet cone nozzles 420 and at least one manifold is for the bellmouth nozzles 310. As illustrated in this embodiment, a bellmouth nozzle manifold 710 may be configured to supply fluid to the bellmouth nozzles 310, and an inlet cone nozzle manifold 720 may be configured to supply fluid to the inlet cone nozzles 420. In an embodiment of the compressor wash system 100, the bellmouth nozzles 310 may require a plurality of bellmouth nozzle manifolds 710 for staging as suitable to produce a desired localized LAR for washing and coverage of the compressor inlet compressor blades. The compressor wash system 100 may be adapted to various compressors of different sizes, and as such the amount of inlet cone nozzles 420, bellmouth nozzles 310, and fluid manifolds 710 and 720 may change accordingly.

Figure 7B:
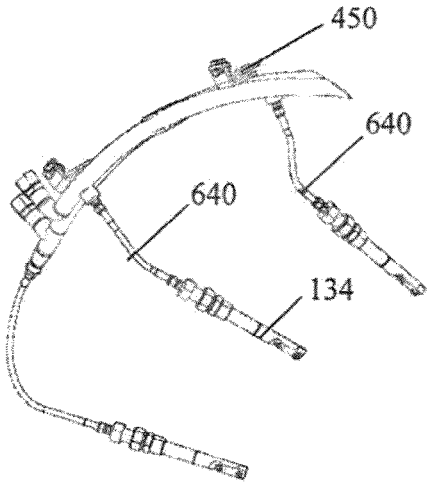
FIG. 7*b* provides a detailed view of features of a compressor wash system according to an embodiment.

With further reference to FIG. 7*a* and with reference to FIG. 7*b*, the manifolds 710 and 720 may include bent rigid tubing or piping with welded t's, thread-o-lets, weld-o-lets or other connectors for minimal connection leak points, for example. The manifolds 710 and 720 may also include bracketing connectors 450 or other hardware for support or to reduce or prevent vibration, for example. Flexible connection 640 may extend from the nozzle body 134 to the manifold weld to reduce or prevent vibration, for example. The manifolds 710 and 720 and flexible connections 640 may be fastened or connected using other suitable means.

According to an embodiment, the bellmouth nozzles 310 and/or the inlet cone nozzles 420 may be connected to SS 304L 1 inch schedule 40 or 80 manifolds, such as manifolds 710 and 720, with stainless steel flexible connection 640 (see FIG. 6 and FIGS. 7*a*-7*b*) connecting between the nozzle body 134 of the nozzle 310 and/or 420 and the manifold 710 and/or 720. In some embodiments, other suitable metals or alloys may be used to manufacture the manifolds or flexible connection 640 such as, but not limited to, other stainless steel, carbon steel, brass, or other suitable materials. Moreover, suitable components, other than flexible connections 640 or manifolds, may be used to supply fluid to the inlet cone nozzles 420 and/or bellmouth nozzles 310.

FIGS. 8*a*-8*d* represent cross-sectional views of portions of a bellmouth assembly 220 and an inlet cone 210 of a compressor inlet 200 according to various embodiments. FIGS. 8*a* and 8*d* represent a cross-sectional view of a portion of an inlet cone 210 on which inlet cone nozzles 420 and corresponding manifold 720 are installed.

FIG. 8*c* includes a cross-sectional view of a portion of an inlet cone 210 on which inlet cone nozzles 420 and corresponding manifold 720 are installed, as well as a portion of a bellmouth assembly 220 on which bellmouth nozzles 310 are installed. In the embodiment illustrated in FIG. 8*c*, the bellmouth spray and inlet cone spray is on during an offline wash operation, and a bellmouth spray pattern 410 and bellmouth spray angle 415, along with an inlet cone spray pattern 430 and inlet cone spray angle 435, are shown. FIG. 8*d* represents a cross-sectional view a portion of an inlet cone 210 on which inlet cone nozzles 420 and corresponding manifold 720 are installed, as well as a portion of a bellmouth assembly 220 on which bellmouth nozzles 310 are installed, with the inlet cone spray on during an offline wash operation. An inlet cone spray pattern 430 is illustrated in the embodiment of FIG. 8*d*.

Figure 9A:
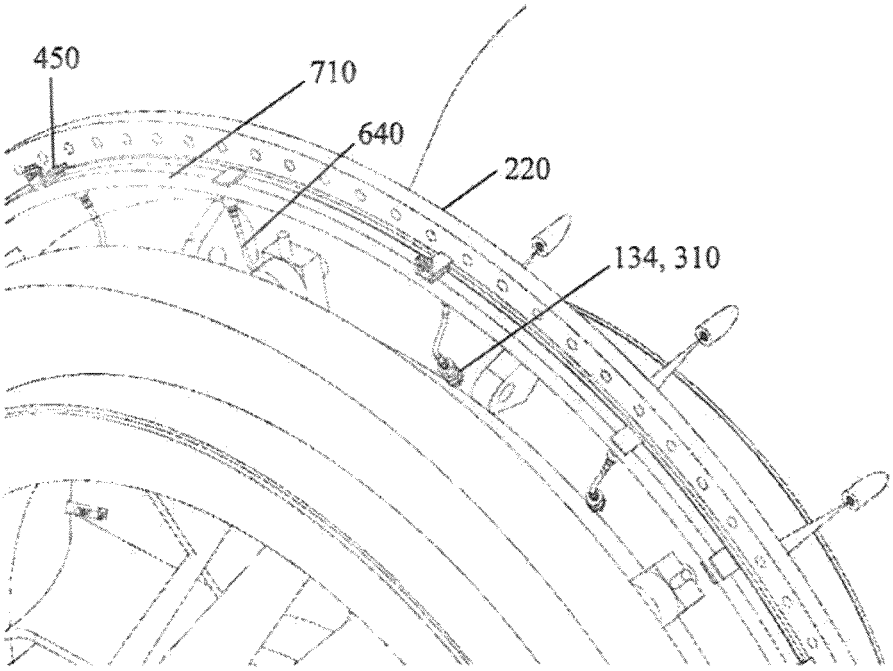
FIGS. 9*a*-9*c* illustrate a compressor wash system installed in a compressor inlet according to embodiments.
Figure 9B:
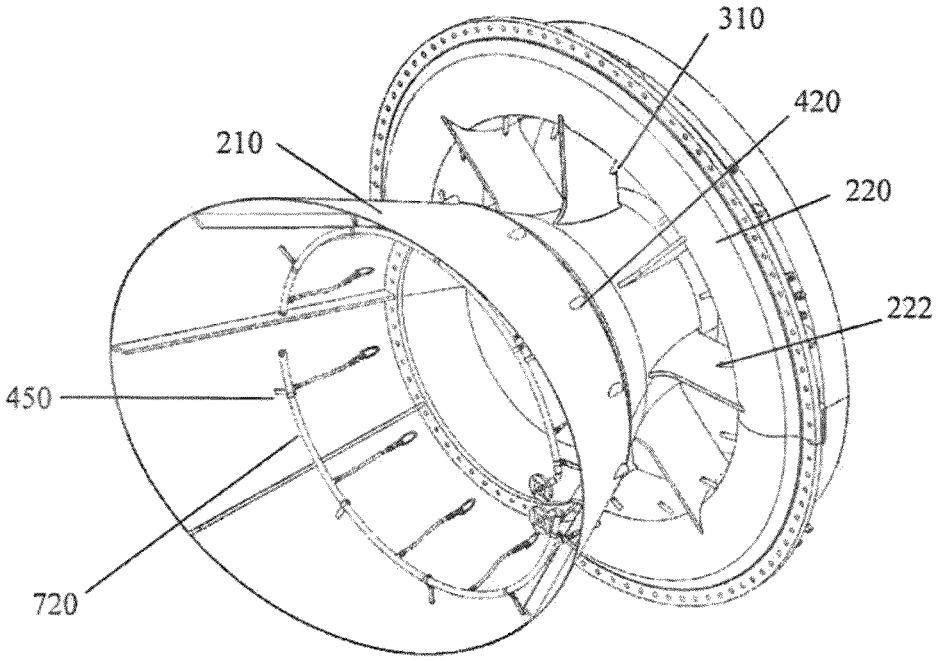
Figure 9C:
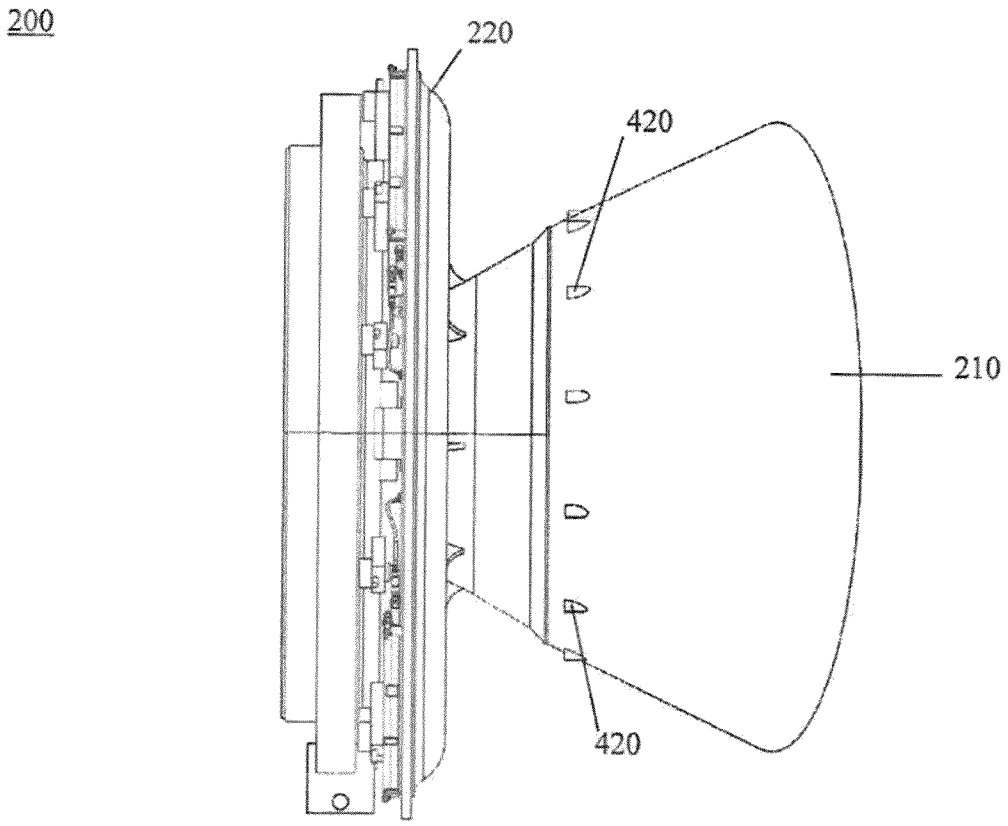

FIGS. 9*a*-9*c* provide detailed views of a compressor wash system 100 installed on a compressor inlet 200. With reference to FIG. 9*a*, a bellmouth nozzle manifold 710 is installed on a bellmouth assembly 220, according to an embodiment. Flexible connections 640 may extend from the nozzle spray body 134 of the bellmouth nozzles 310 to the manifold weld. In some embodiments, bracketing hardware 450 is used for bellmouth nozzle manifold 710 support and/or to reduce or prevent vibration. Of course other suitable devices, materials, or methods may be used for bellmouth nozzle manifold 710 support and/or to reduce or prevent vibration.

With reference to FIG. 9*b*, an inlet cone nozzle manifold 720 may be installed within the circumference of an inlet cone 210 of a compressor inlet 200. The inlet cone nozzle manifold 720 may supply fluid to the inlet cone nozzles 420. Bellmouth nozzles 310 may be spaced around the circumference of the bellmouth assembly 220, and a bellmouth nozzle manifold 710 may supply fluid to the bellmouth nozzles 310. In some embodiments, bracketing hardware 450 is used for inlet cone nozzle manifold 720 support or to reduce or prevent vibration.

FIG. 9*c* provides a side view of the compressor inlet 200 with compressor wash system 100 installed thereon inlet cone nozzles 420 may be installed around the circumference of an inlet cone 210 and may be connected to an inlet cone nozzle manifold 720 (not shown in FIG. 9*c*) for receiving fluid therefrom. Moreover, bellmouth nozzles 310 may be installed in a bellmouth assembly 220 and may be connected to a bellmouth nozzle manifold 710 (not shown in FIG. 9*c*) for receiving fluid therefrom. In this manner, the inlet cone nozzles 420 and/or the bellmouth nozzles 310 may direct fluid into or in a direction of the inlet air flow path of the compressor inlet 200 and with the line of sight of the compressor blades for washing of the compressor. The bellmouth and/or inlet cone nozzles 310, 420, respectively, may operate during both online and offline wash operations, as described above.

Returning to FIG. 1, an embodiment of sequencing is illustrated in which the manifolds 710 and 720 may join at a common header (the pump 110) and are isolated from each other with control valves 140. In FIG. 1, one or more bellmouth nozzle manifolds 710 may be represented by one or more of the nozzle sets 130, while one or more inlet cone nozzle manifolds 720 may be represented by one or more of the other nozzle sets 130. Both the bellmouth nozzle manifold 710 and the inlet cone nozzle manifold 720 may direct fluid, heated to approximately 140° F., operating at a nominal 900 psi high pressure, for example, to either stage one nozzle set 130, stage two nozzle set 130, stage three nozzle set 130, or a combination of stage one, two, and three nozzle sets 130 for between one and five minutes per stage. Other embodiments of sequencing may, for example, vary the temperature or pressure of the fluid and may include a plurality of staged nozzle sets or a plurality of high pressure control valves 140.

Various sequencing operations may be provided as corresponding sets of computer-executable instructions that are stored in one or more memory components. A computing device 1100 (see FIG. 1) may access and run the computer-executable instructions in order to perform a desired sequencing operation. To that end, the computing device 1100 may include a processing element embodied as a processor, a co-processor, a controller, or various other processing means or devices including integrated circuits. The processing element is capable of accessing and executing the instructions to control or otherwise operate the pump 110 and the control valves 140 and the drain valve 160 to achieve the desired sequencing operation. The computer-executable instructions may be stored on a remote server (not shown) or within a local memory component 1120 of the computing device 1100, where the memory component may include volatile or non-volatile memory, for storing information, instructions, or the like. The computing device 1100 is connected, via a wired connection or a wireless connection or a combination thereof, to the pump 110, the control valves 140, and the drain valve 160 to accordingly control the components to perform the desired operation.

Figure 10:
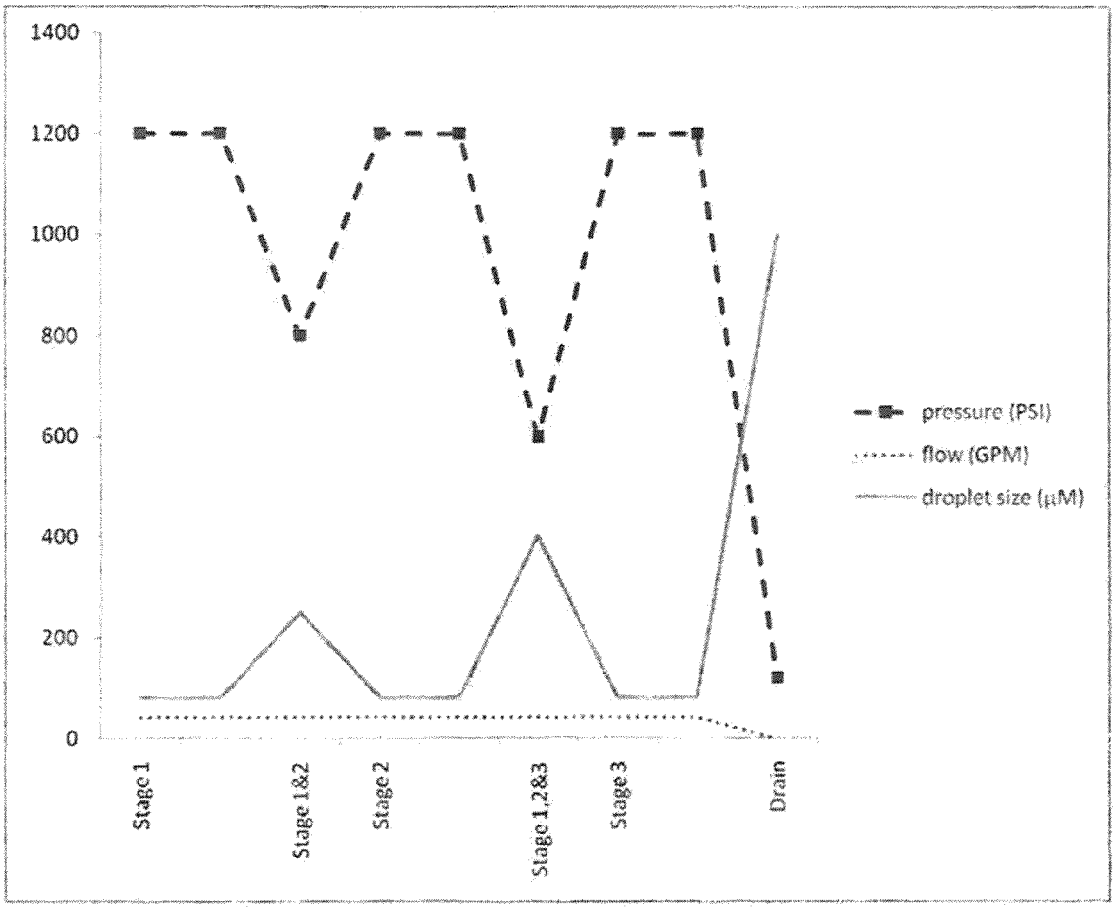
FIG. 10 is a line graph demonstrating constant flow with variable nozzle back pressure and droplet size when different nozzle stages are opened.

FIG. 10 is a line graph that illustrates various parameters associated with the stages of the compressor wash system 100. In particular, FIG. 10 illustrates constant flow with variable nozzle back pressure and droplet size when different nozzle stages (i.e., stage one, two, and/or three nozzle sets 130) are activated. For example, when switching between stage one, two, or three nozzle sets 130, multiple control valves 140 may open, causing a low pressure spike resulting in a burst of larger droplets of fluid. During a low pressure spike, the fluid flow to the respective nozzle sets 130 remains relatively constant because the pump 110, which may be, according to an embodiment, a positive displacement pump, maintains a constant fluid flow. FIG. 10 also illustrates an embodiment where stages one through three are activated at the same time, causing a low pressure spike resulting in a burst of larger droplets of fluid.

Another feature of a staged compressor wash system, such as the compressor wash system 100, is that mean fluid droplet size may be varied throughout operation. For example, in a three stage system, with only one high pressure control valve 140 open, the fluid droplet size may range from about 50 μm to about 500 μm with a deviation in the ninetieth percentile. The smaller fluid droplet size aides in the scrubbing action of the wash system 100 while limiting the blade erosion of the compressor blades. Smaller fluid droplet sizes have less mass and momentum and may cause less erosion and/or wear in a given compressor than larger fluid droplet sizes. However, larger fluid droplet sizes may be desired for a more aggressive scrubbing action of the compressor blades. In some embodiments, larger droplet sizes may be used in short bursts with less than 20 percent of the total fluid consumption of an online or offline was process. Again, other suitable fluid droplet sizes and duration of fluid consumption may be formed by using the staged compressor wash system 100.

The compressor wash system 100 also includes a feature to prevent or reduce droplet breakup or droplet coalescence. Injecting fluid droplets into a high velocity air stream, such as the inlet of a compressor, may cause the fluid droplets to breakup, reducing the cleaning effectiveness of a compressor wash system. Varying the activation of stages and/or fluid operating pressures may reduce or prevent droplet breakup when injecting the compressor wash droplets into the compressor. In one embodiment, the bellmouth nozzles 310 and inlet cone nozzles 420 may have an operating pressure range from about 600 to about 1200 psi to reduce or prevent droplet breakup when injecting the droplets into the high velocity air stream inside of a compressor. Certain nozzle designs may produce spray pattern shapes, such as but not limited to certain cone shape spray patterns, that may cause droplets to coalesce, collide, or cause droplet interference when injected into a compressor, reducing the cleaning effectiveness of a compressor wash system. In some embodiments, the bellmouth nozzles 310 and/or inlet cone nozzles 420 are designed to produce spray patterns, such as a bellmouth spray pattern 410 and/or an inlet cone spray pattern 430, that are area flat fan shape to reduce or prevent droplets to coalesce, collide, or cause droplet interference. U.S. Pat. No. 5,868,860, which is hereby incorporated by reference, includes further information related to operating pressures and pressure ranges.

Figure 11:
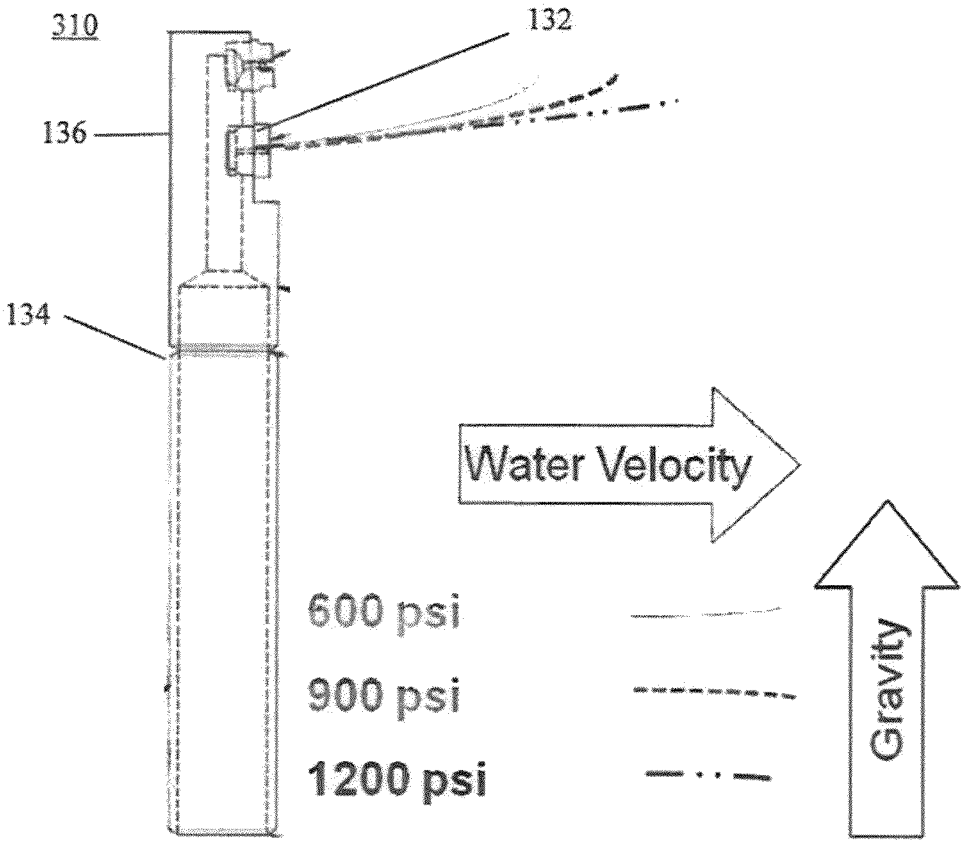
FIG. 11 is a pictorial demonstrating fluid trajectory with varying nozzle fluid flow and pressure versus constant engine normalized load.

FIG. 11 is a pictorial demonstrating fluid trajectory varying nozzle fluid flow and pressure versus constant engine normalized load. FIG. 11 illustrates that when cycling between high pressure control valves, such as the control valves 140, the line back pressure may drop, causing the fluid trajectory from either the bellmouth nozzles 310 or inlet cone nozzles 420 to differ slightly and cause fluid impingement on the blades in slightly different radial locations. Variation of fluid trajectory during cycling between high pressure control valves 140 may work well for both online and offline scenarios. In some embodiments, changing the fluid trajectory may be beneficial to the scrubbing action of the compressor wash system 100 because the fluid impingement may clean different areas of the compressor blades. For example, when the line back pressure is 1200 psi, the fluid trajectory velocity is such that the fluid impingement may clean more of the compressor blade tip rather than the compressor blade root or midspan. In another embodiment, use of modulating valves as the control valves 140 may be used to maintain the pressure in a range of 600-1200 psi or other desired pressure ranges. In other embodiments, the bellmouth nozzles 310 are installed such that the nozzle spray tips 136 extend into the inlet air flow path of a compressor and the nozzles 132 are with the line of sight of the compressor blades such that the fluid trajectory is with the inlet air flow and directed to the line of sight of the compressor blades. Another embodiment (not shown) may vary fluid trajectory from inlet cone nozzles 420. For example, when the line back pressure is 1200 psi, the inlet cone nozzle 420 fluid trajectory may be such that the fluid impingement may clean more of the compressor blade midspan rather than the compressor blade root. When the line back pressure is 600 psi, the inlet cone nozzle 420 fluid trajectory may be such that the fluid impingement may clean more of the compressor blade root rather than the compressor blade midspan.

Figure 12:
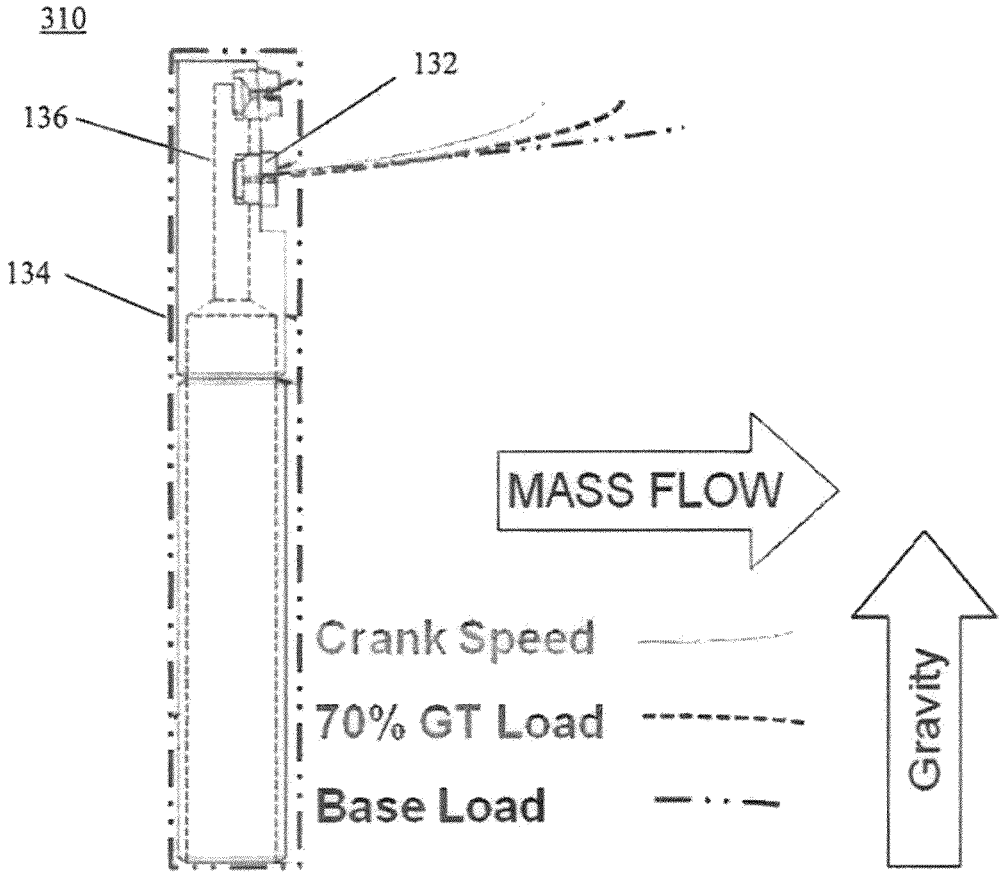
FIG. 12 is a pictorial demonstrating fluid trajectory with varying compressor load versus constant nozzle fluid flow and pressure.

FIG. 12 is a pictorial demonstrating fluid trajectory for a given compressor speed or engine normalized load versus constant nozzle fluid flow and pressure. FIG. 12 illustrates that fluctuating between 0% and 100% of a normalized load of a gas turbine for which a turbine may operate may cause the fluid trajectory to differ slightly and cause fluid impingement on the blades in different radial locations. Variation of fluid trajectory through fluctuation in gas turbine normalized load may be more pertinent in online scenarios. For example, when the turbine is at base load, the inlet air velocity may be increased; therefore, the fluid impingement may clean more of the compressor blade root rather than the compressor blade tip from the inlet cone nozzles 420 (not shown). When the turbine is at baseload, the bellmouth nozzles 310 fluid trajectory may cause the fluid impingement to clean more of the compressor blade tip rather than the compressor blade midspan. In another embodiment, compressor speed may have the same effect as engine normalized load on the fluid trajectory from the inlet cone nozzles 420 and/or bellmouth nozzles 310.

A staged compressor wash system, such as the system 100, may be configured to vary the line back pressure during cycling between high pressure control valves 140 to achieve a desired fluid trajectory from the bellmouth or inlet cone nozzles 310, 420. Other embodiments may include a plurality of modulating valves that may be used to configure variations in line back pressure to achieve a desired fluid trajectory from the bellmouth or inlet cone nozzles 310, 420. For example, if a user wishes to increase inlet throat coverage while a gas turbine is at base load, a staged compressor wash system may maintain a desired line back pressure by using modulating valves to both increase inlet throat coverage and maintain line back pressure. A compressor wash system may open a stage one modulating valve thirty percent, a stage two modulating valve forty percent, and a stage three modulating valve ten percent to maintain a desired line back pressure and/or to control a desired liquid to air ratio. Of course, one or more modulating valves may be utilized and various configurations and operating positions may be configured to maintain a desired line back pressure or liquid to air ratio while increasing inlet throat coverage. Additionally, a staged compressor wash system may be configured so that a desired fluid trajectory from the bellmouth or inlet cone nozzles 310, 420 is achieved at a particular gas turbine normalized load or compressor speed. Some embodiments may include a compressor, including but not limited to gas compressors or centrifugal compressors, where a desired fluid trajectory from a wash nozzle may be configured based upon a particular compressor operating speed, for example.

In another embodiment, online washing may utilize a combination of changing the as turbine load and fluctuating the nozzle backpressure by opening a high pressure control valve 140 on a given manifold (either on the drain stage or one of the nozzle sets 130) for washing of different blade coverage, both circumferentially and radially.

According to an embodiment, the compressor wash system 100 shown in FIG. 1 may include a drain control valve 160 that may be used to fluctuate the nozzle backpressure to a desired pressure range. When the drain control valve 160 is modulated, the backpressure on the nozzles is changed, providing a different fluid droplet size and fluid trajectory from the respective fluid nozzles to the compressor blades.

Still referencing FIG. 1, according to an embodiment, stage one, two, and three nozzle sets 130 may have similar pressure drops for the same fluid flow and fluid droplet size, however, the amount of nozzles 132 per stage may differ. For example, one embodiment may include 10 inlet cone nozzles 420 for stage one and 20 bellmouth nozzles 310 for stage two. Other embodiments may include more or less inlet cone nozzles 420 and bellmouth nozzles 310 per stage.

Stage combinations may be opened together for brief moments of time, i.e. one minute or less, to allow for droplets of different sizes to scrub the blades in different areas. For example, if a high pressure control valve 140 for stage one nozzle set 130 is opened while that of stage two nozzle set 130 and stage three nozzle set 130*c* are closed, the fluid droplet size will be larger than if the high pressure control valves 140 for stages one, two, and three nozzle sets 130 are opened together. Other suitable configurations of nozzles 132 per stage may be provided, and the timing of stage combinations may be configured for any applications and may be timed to open together for greater than one minute.

Figure 13:
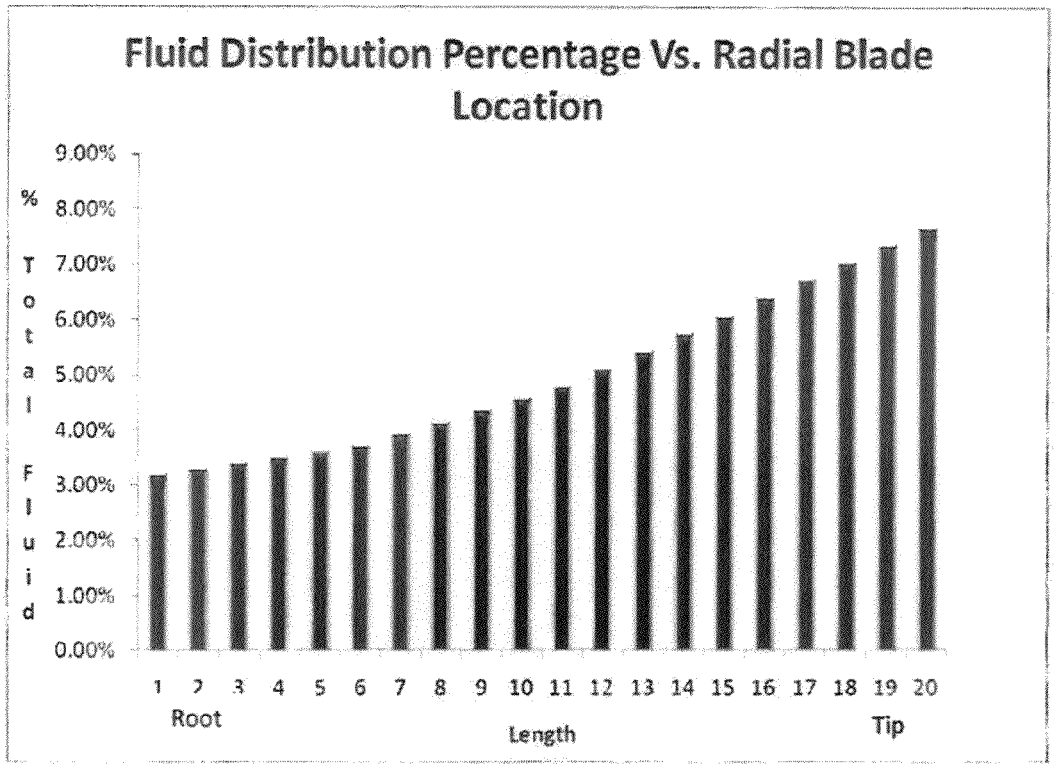
FIG. 13 is a bar graph of total fluid flow distribution from compressor blade root to compressor blade tip.

FIG. 13 is a bar graph of total fluid flow distribution from compressor blade root to compressor blade tip where length 1 represents an area closer to the compressor blade root, and length 20 represents an area closer to the compressor blade tip. FIG. 13 illustrates a total percentage of a cleaning fluid desired, according to an embodiment, per radial blade location for an online wash at the compressor blades for a side inlet air filter housing. A target of obtaining a consistent localized fluid to air ratio (LAR) per unit of time, or flux density ratio, provides for a consistent wetting and scrubbing through the inlet throat of the compressor and downstream blades for each of the stages cumulative spray coverage. According to one embodiment, bellmouth nozzles 310 must cover a larger area for wetting and scrubbing than inlet cone nozzles 420. To maintain a consistent LAR, more bellmouth nozzles 310 may be required to provide more fluid than inlet cone nozzles 420. Other embodiments may be configured with fewer bellmouth nozzles 310 but greater fluid flow to the bellmouth nozzles 310 than to the inlet cone nozzles 420. Of course, other suitable variations of bellmouth nozzles 310, inlet cone nozzles 420, fluid flow rates, pressures, and droplet sizes may be implemented to maintain consistent LAR per unit of time, or flux density ratio.

Figure 14:
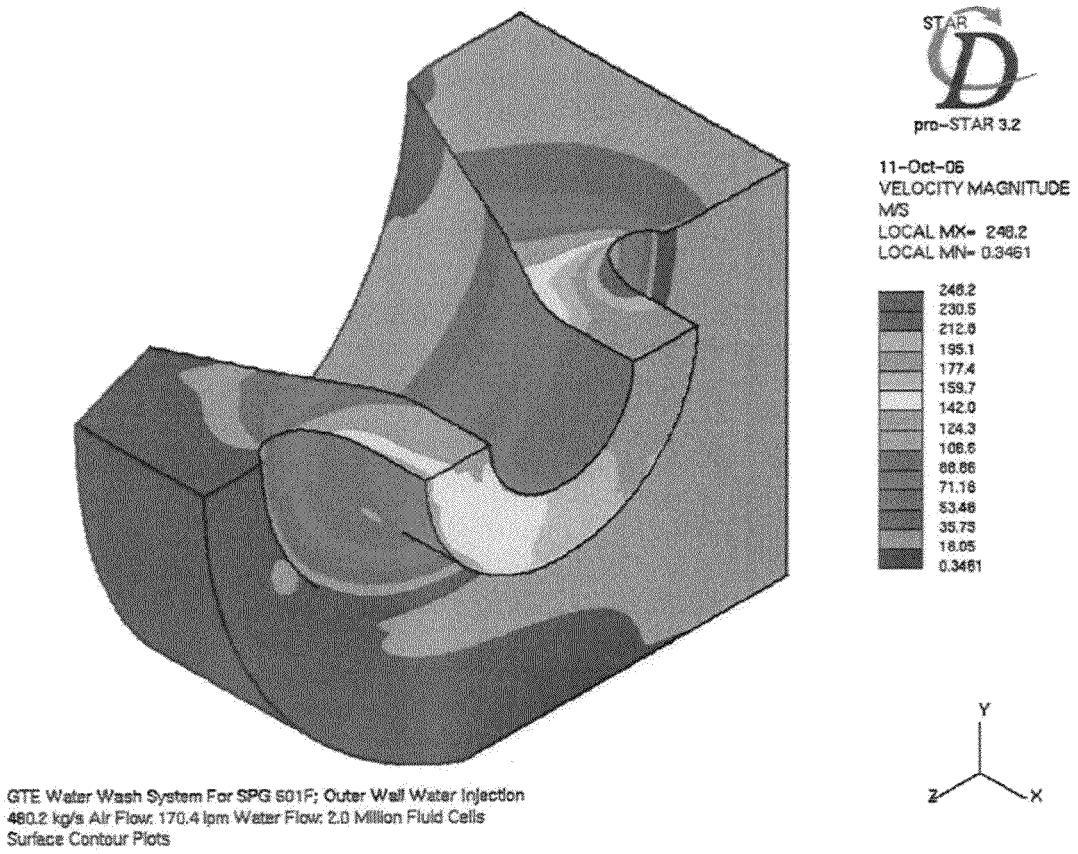
FIG. 14 is an air velocity profile of a side inlet configuration at base load.

FIG. 14 illustrates an embodiment of a computational fluid dynamic (CM model that illustrates the variation of inlet air velocity of a side inlet configuration at base load from the rotor to the compressor outer casing, or radially along the compressor rotating blades from root to tip. The higher velocities are shown in red, and the lowest velocities are shown in blue. The highest velocities of orange and red are found at the compressor blades toward the compressor casing, away from the compressor centerline. Moreover, the compressor blade tips have a higher localized velocity than the compressor blade roots. Thus, while the turbine is running, the compressor blade tips may require more fluid to clean than the compressor blade roots. Also, a greater need for fluid flow at the compressor blade tips may be required to maintain a consistent flux density ratio of fluid to air. Some embodiments may include more stages of bellmouth nozzles 310 than stages of inlet cone nozzles 420, or more bellmouth nozzles 310 per stage than inlet cone nozzles 420 per stage to provide for more fluid to maintain a consistent flux density ratio of fluid to air from the compressor blade roots to the compressor blade tips. While FIG. 14 illustrates a CFD model for a particular turbine, a CFD model may be generated for any compressor or turbine to determine the proper configuration for the multi stage water wash system with the use of bellmouth and cone mounted nozzles for other compressors.

Referring again to the embodiment of FIG. 1, three stages of high pressure control valves 140 may be configured to inject fluid into three manifolds with compressor wash nozzles 132. Stage one may control, for example, the fluid injection into inlet cone nozzles 420 aimed at the smaller area of the compressor blade root to midspan. Stage two and stage three may control, for example, the fluid injection into bellmouth nozzles 310 aimed at the compressor blade midspan to tip, focused on a larger area of compressor blade coverage per stage, and downstream compressor blades. Because the positive displacement pump, such as the pump 110, may supply constant fluid flow, when stage two or stage three nozzles are active, the flux density ratio may be relatively consistent radially along the compressor blades because of the constant fluid flow to the stage two or stage three nozzles directed to a larger area. Various other suitable configurations of stages of high pressure valves, manifolds, nozzles, and nozzle sets may be implemented in order to maintain a consistent flux density ratio throughout the inlet area of the compressor, or to achieve other desired operational results to account for different compressors or turbines.

Nozzle tip positioning of a staged compressor wash system, such as the system 100, may require line of sight to the compressor blades and may be used for both online and offline washing operations. The thickness of the nozzle body 134 may be greater than 0.25 inches in diameter, with a minimal wall thickness of approximately 0.0125 inches for rugged, industrial applications that are not excited by a frequency range of 0-120 Hz. For other applications, a nozzle body 134 with a nozzle body thickness less than 0.25 inches in diameter with wall thickness less than 0.0125 inches, depending on the nozzle body material, may be utilized. With reference again to FIG. 6, the nozzle spray tip 136 may include a flat surface 630 to enable a wrench or other tool to hold the nozzle body 134 while tightening. The nozzle body 134 may also include a lock collar 620 that may allow for installation of the nozzle 132 from outside the inlet air flow path to inside the inlet air now path, thus eliminating or reducing the possibility for a loose connection to allow a nozzle 132 or other material to fall into the undesired inlet air flow path. Bellmouth installation tooling may be required to properly align the positioning angle of the nozzle tip 136. The bellmouth installation tooling may include a hydraulic drill press (not shown) for alignment of the nozzle tips 136 and desired trajectory angle of the nozzle tips 136.

Figure 15A:
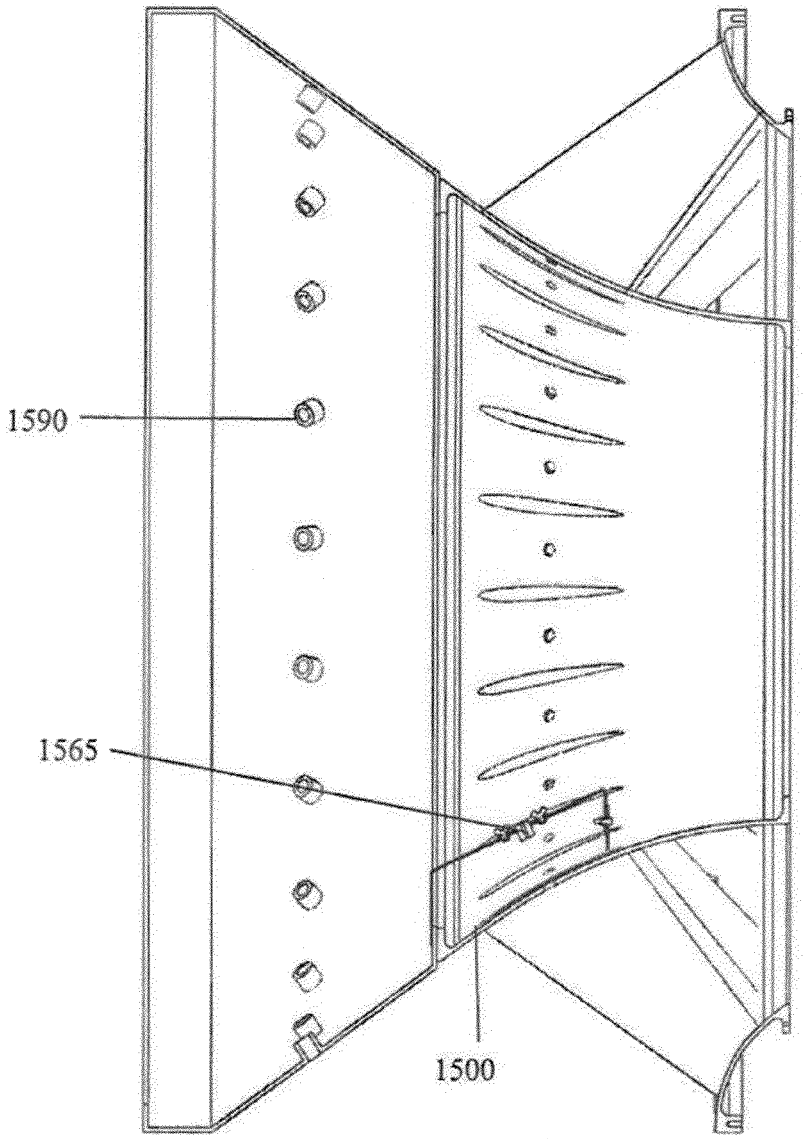
FIGS. 15*a*-15*o* illustrate templates and molds for installing bellmouth and inlet cone nozzles according to embodiments.
Figure 15B:
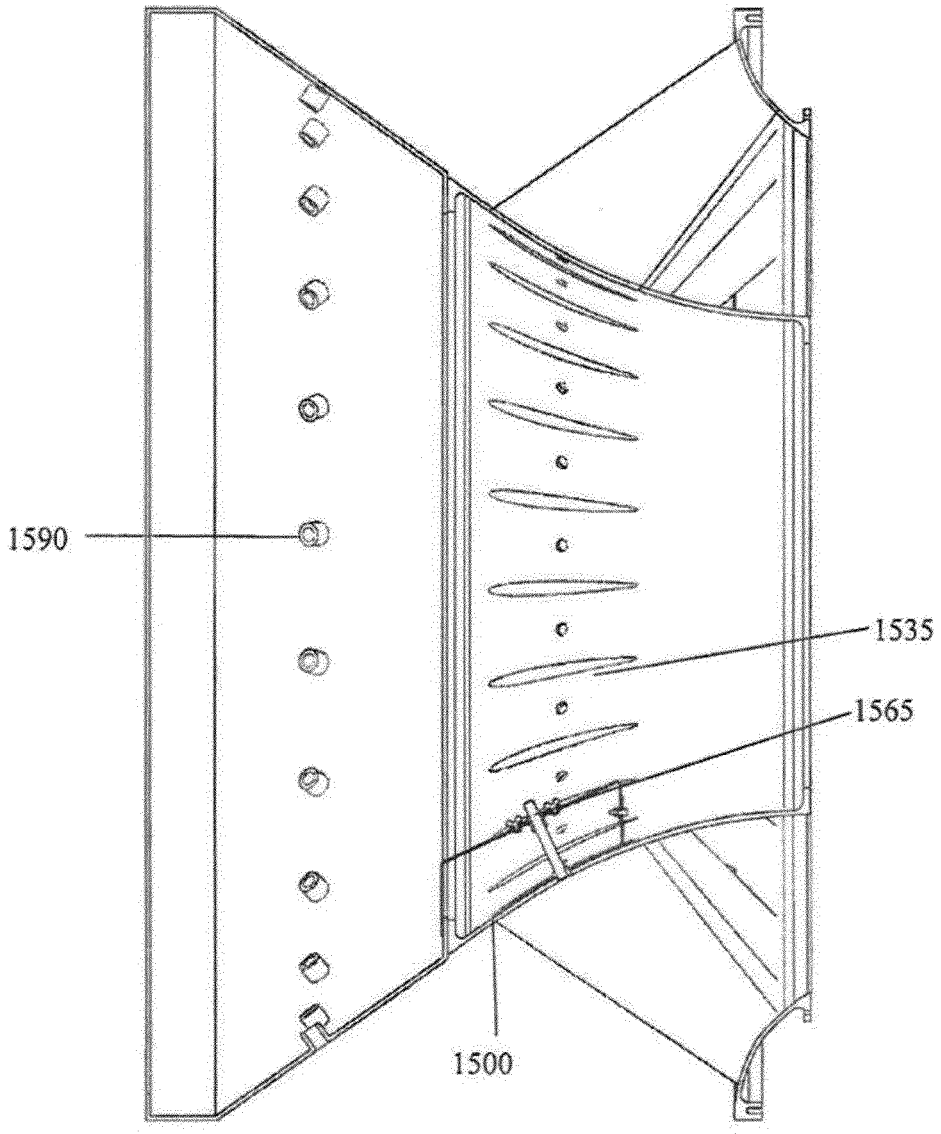
Figure 15C:
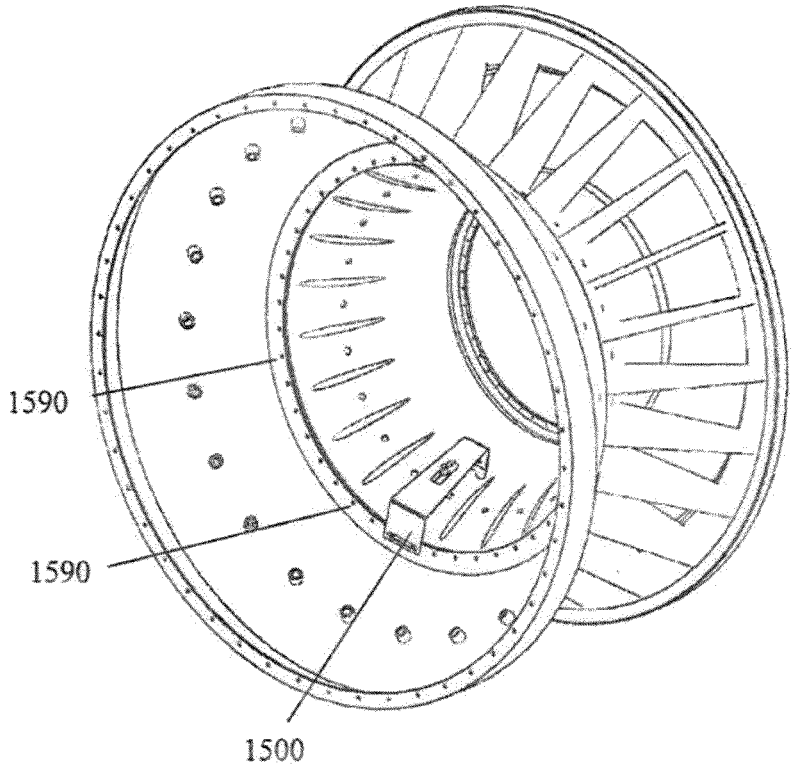
Figure 15D:
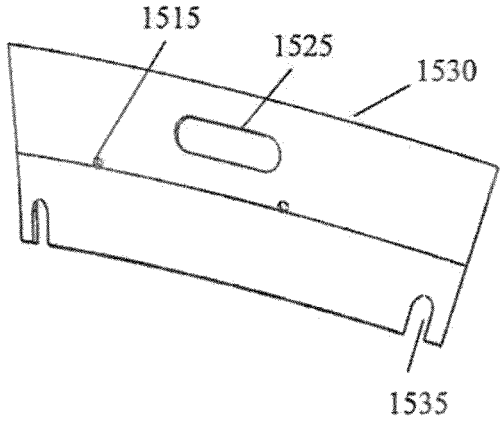
Figure 15E:
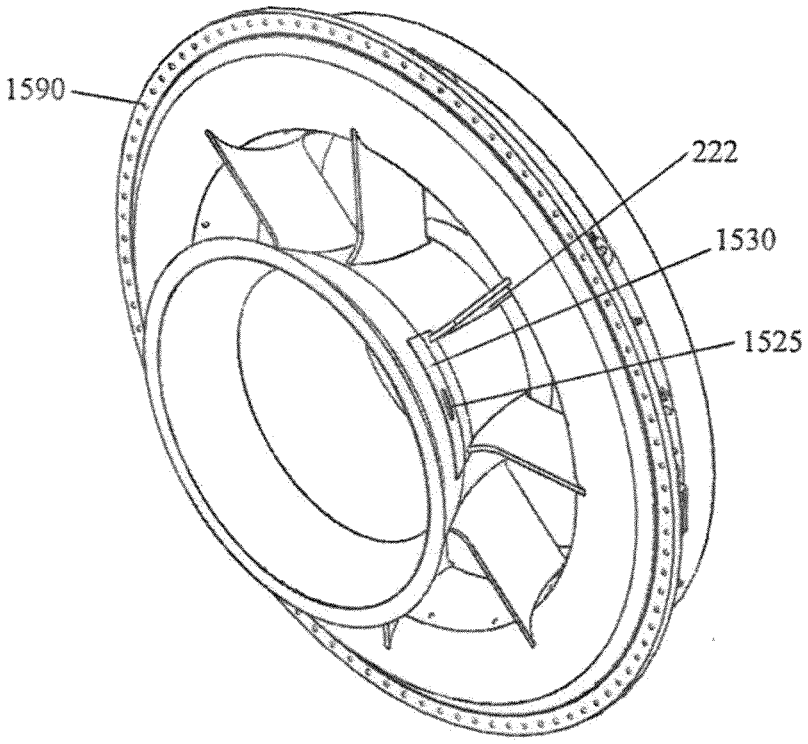
Figure 15F:
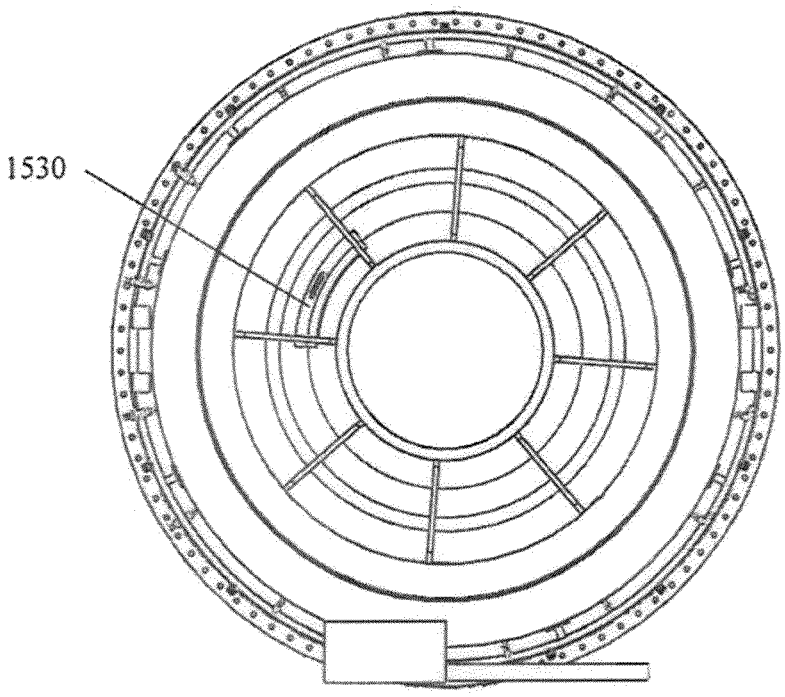
Figure 15G:
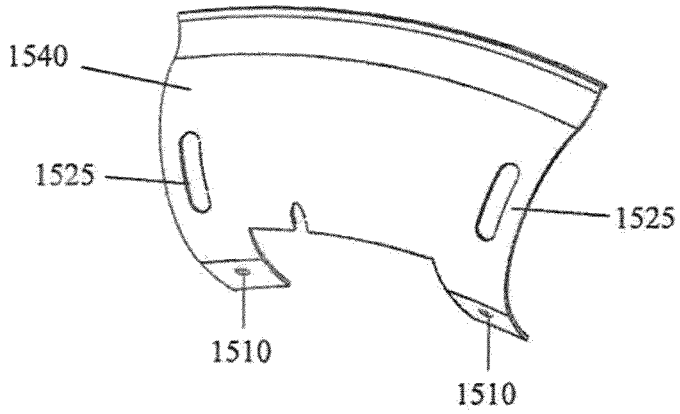
Figure 15H:
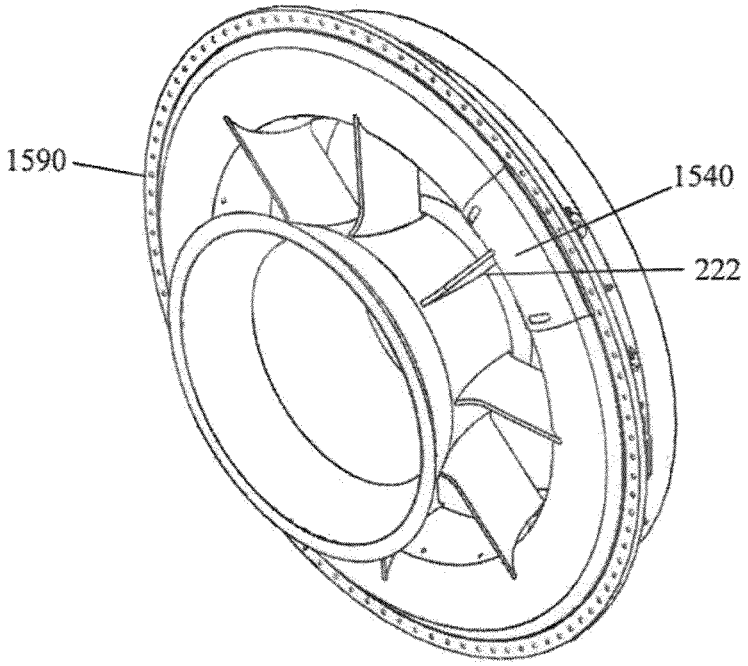
Figure 15I:
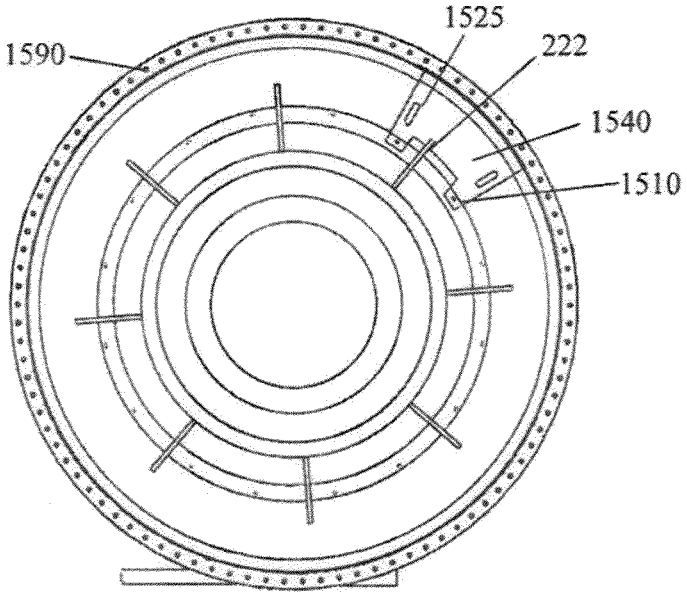
Figure 15J:
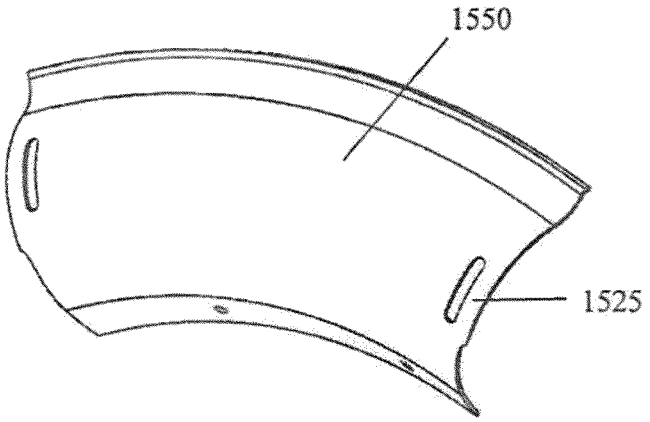
Figure 15K:
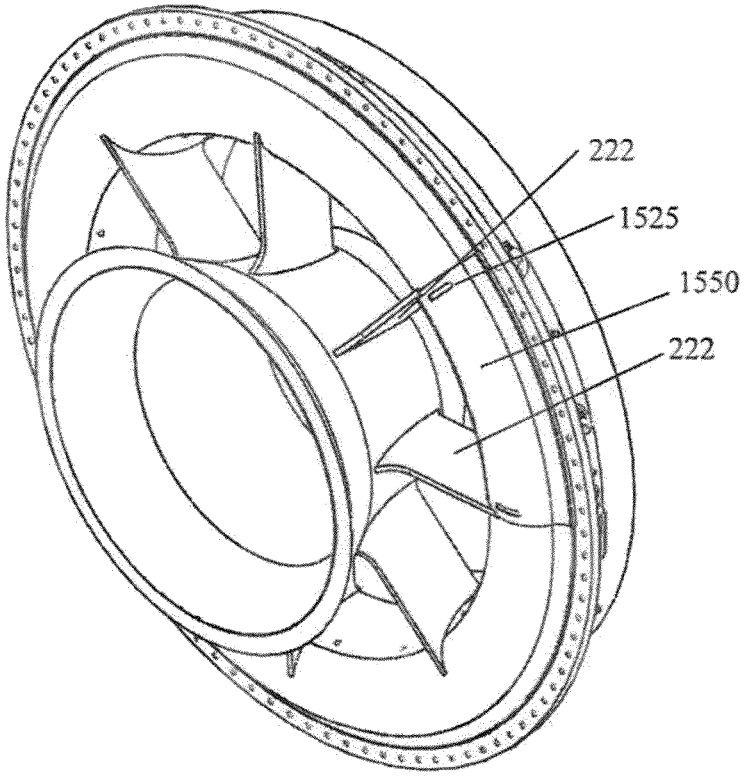
Figure 15L:
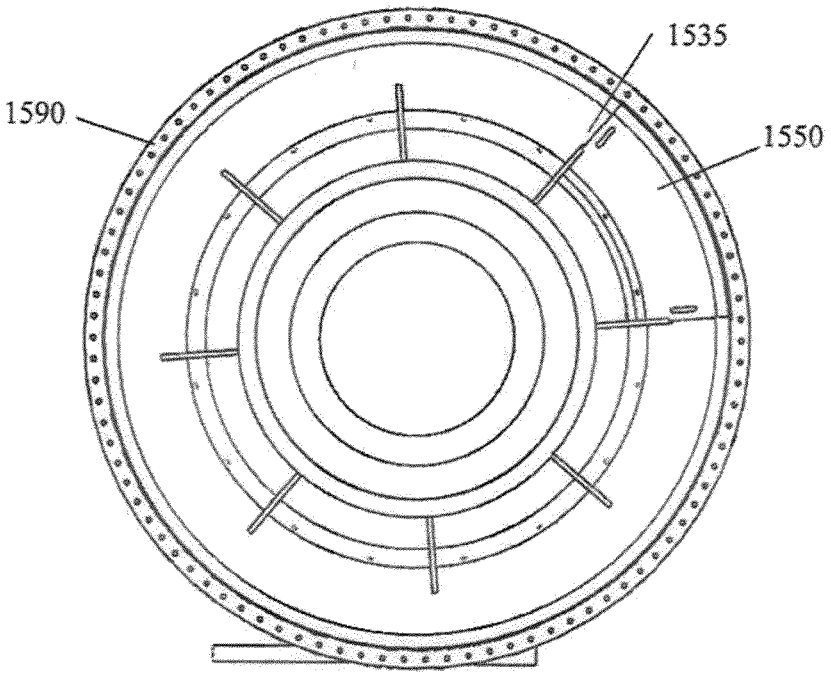
Figure 15M:
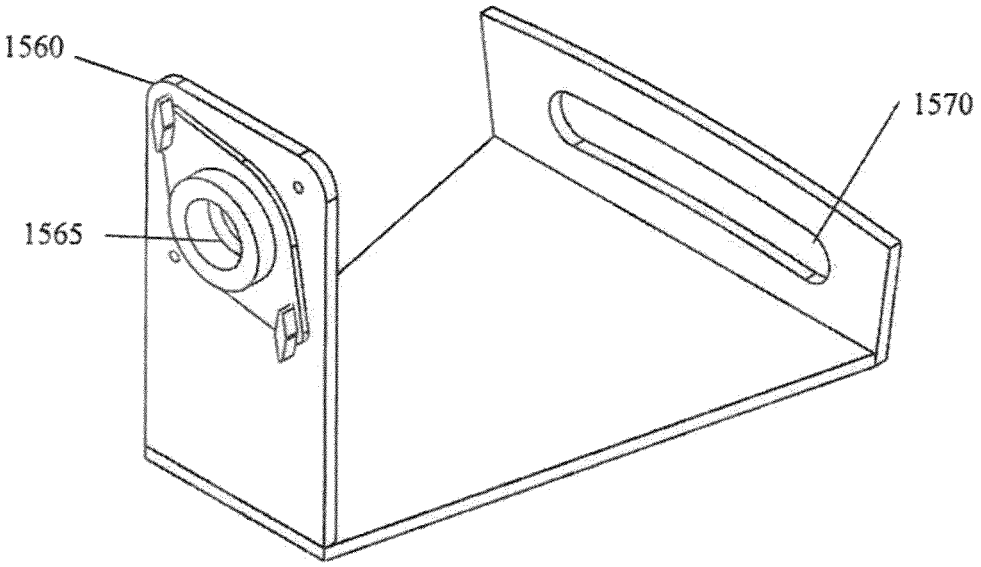
Figure 15N:
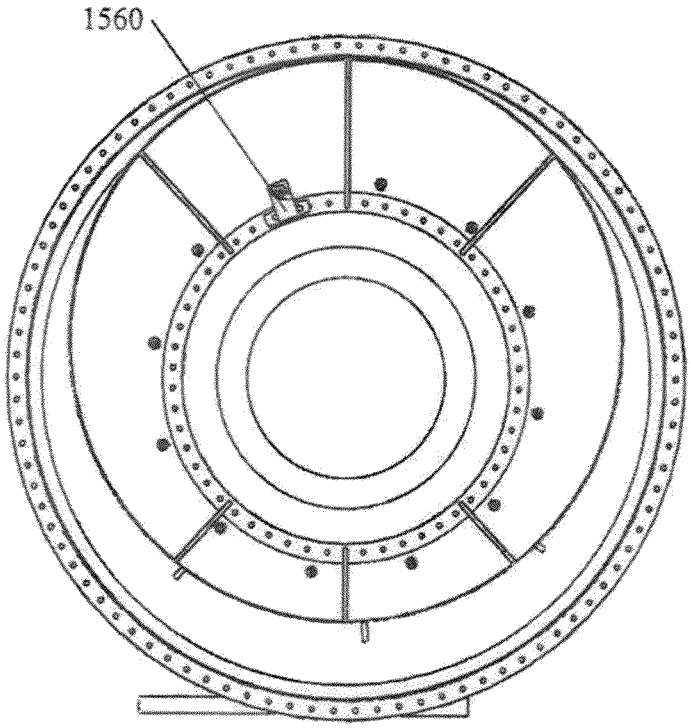
Figure 15O:
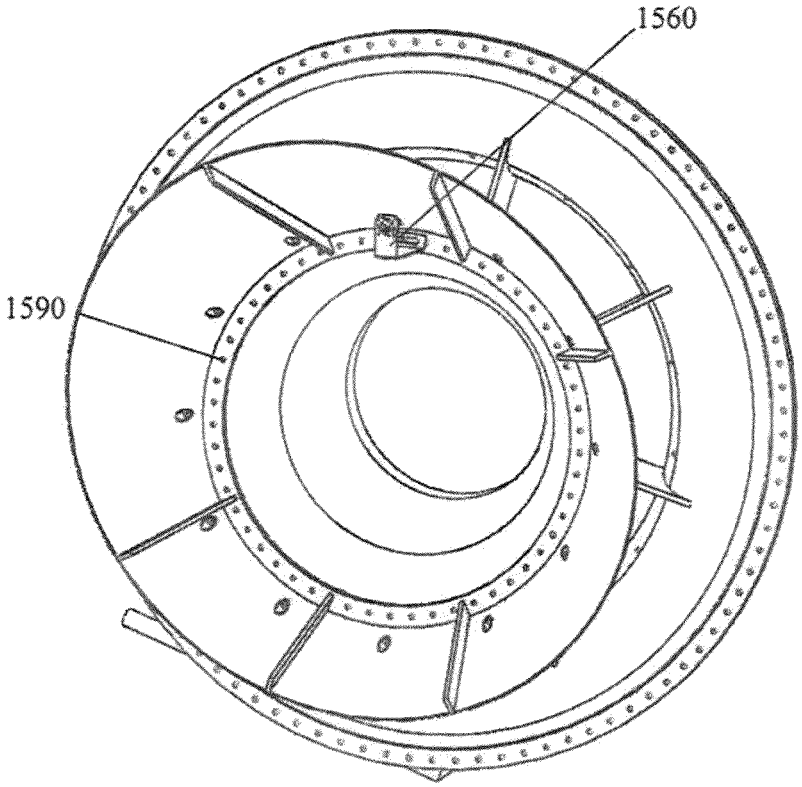

With reference to FIGS. 15*a*-15*o*, templates and molds used for installing bellmouth nozzles 310 and inlet cone nozzles 420, according to various embodiments, are illustrated.

According to an embodiment, bellmouth installation tooling may include one or more form fitting templates, shown in FIGS. 15*d* and 15*l* and the from view perspective of FIG. 15*e*, looking with flow. Bellmouth nozzle ports may be drilled into the casing of the bellmouth assembly 220 for nozzle tip insertion into the flow path of the compressor. The bellmouth nozzle ports may be drilled so that the nozzle tips 136 achieve the required or desired line of sight to the compressor blades. The form fitting templates material may range from rigid plastics to flexible magnets or any other suitable materials.

The installation procedure may include, but is not limited to, use of a primary template 1540 to mark the location of the bellmouth nozzle port penetrations 1510 on the bellmouth assembly 220 to spot or otherwise indicate the penetrating location of the drill bit. Referring to FIGS. 8*b* and 15*d*-15*l*, a secondary template 1530 may be used to mark the straight line projection 1520 of the bearing hub alignment point 1515 on the inlet cone 210 and may be used to mark the drill press push point. A specially designed drill with a pneumatic jack may be used once the push off point, or bearing hub alignment point 1510, and bellmouth nozzle port penetration point 1510 is determined from the primary and secondary templates. According to other embodiments, a secondary template 1530 may include a strut alignment notch 1535 to be used for alignment of the secondary template 1530. Other embodiments may use existing bolt hole circles 1590 on a bellmouth assembly 220 as a reference to align templates. Of course other suitable methods of determining the straight line projection 1520 and penetrating location of the drill bit may be used.

Other embodiments may include a single template used on the inlet cone 210 or bellmouth assembly 220 to mark the location of the respective port penetrations on either the inlet cone 210 or bellmouth assembly 220. A single template may also be used to mark the straight line projection 1520 of the bearing hub alignment point 1515 on the inlet cone 210 and to mark the drill press push point.

A secondary template 1530 is represented in FIG. 15*d* and is also shown, in FIGS. 15*e* and 15*f*, applied to a compressor inlet, such as the exemplary compressor inlet 200. The secondary template 1530 may be configured to fit between two struts 222 of the bellmouth assembly 220 and may be utilized to indicate or mark locations of port penetrations for a drill or other equipment to create an opening for nozzle tip insertion and placement.

A one strut primary template 1540 is illustrated in FIG. 15*g*. The one strut primary template 1540 is configured to be positioned around one strut 222 of the bellmouth assembly 220. FIGS. 15*h* and 15*i* provide an illustration of the one strut primary template 1540 positioned on the compressor inlet 200. Some embodiments include one or more handles 1525 for easier installation and portability.

With reference to FIG. 15*j*, a two strut primary template 1550 configured to be positioned around two struts 222 is illustrated. FIGS. 15*k* and 15*l* provide an illustration of the two strut primary template 1550 positioned on the compressor inlet 200.

The one strut primary template 1540 and the two strut primary template 1550 may be utilized to mark bellmouth nozzle port penetration points 1510 for insertion and placement of bellmouth nozzles 310. According to some embodiments, the struts 222 may be used to align a cone nozzle installation tool 1560, or nozzle installation tool 1500. Of course any template or tool may be aligned using one or more struts 222, bolt hole circles 1590, or other reference inside the compressor inlet.

According to an embodiment, a cone installation tool 1500, shown in the cutaway views of FIGS. 15*a* and 15*b* and the front view perspective of FIG. 15*c* may be used to install inlet cone nozzles 420. One or more cone installation tools 1500 may be used for inlet cone nozzle 420 placement or to properly align the positioning angle of the nozzle tip 136. The cone installation tool 1500 may be configured to attach to the inlet cone 210 of the compressor inlet.

In some embodiments, a cone installation tool 1500 may have an inserted drill bit guide 1565 with a drilling alignment angle to properly drill a positioning angle for the nozzle tips 136. A drill bit guide 1565 may include a predefined two-dimensional angle to guide a drill bit during nozzle 132 installations. One embodiment includes removable drill bit guides 1565 that may be used with a cone installation tool 1500 where multiple drill it guides 1565 are used in a drilling process to accommodate various drill bit sizes. A cone installation tool 1500 may be positioned on an inlet cone 210 by using existing bolt hole circles 1590 as reference points. In another embodiment, struts 222 may be used to position a cone installation tool 1500. Of course a cone installation tool 1500 may be used to install bellmouth nozzles 310 and templates may be used to install inlet cone nozzles 420 and any combination of tools or templates may be used for installing nozzles 132.

With reference to FIG. 15*m*, a cone nozzle installation tool 1560 is illustrated. The cone nozzle installation tool 1560 is configured to attach to the inlet cone 210 of the compressor inlet 200, as further illustrated in FIGS. 15*n* and 15*o*. The cone nozzle installation tool 1560 provides a template for marking or otherwise indicating port penetrations for insertion and placement of inlet cone nozzles 420. In some embodiments, a cone nozzle installation tool 1560 may have an inserted drill bit guide 1565 that may be used for a drilling alignment angle. An inserted drill bit guide 1565 may also be used for bellmouth templates that provides a drilling alignment angle or drilling depth. One embodiment includes removable drill bit guides 1565 that may be used with a cone nozzle installation tool 1560 where multiple drill hit guides 1565 are used in a drilling process to accommodate various drill bit sizes. Another embodiment includes a bolt alignment hole 1570 (FIG. 15*m*) to align a cone nozzle installation tool 1560 by using existing bolt hole circles 1590 as reference points.

Figure 16:
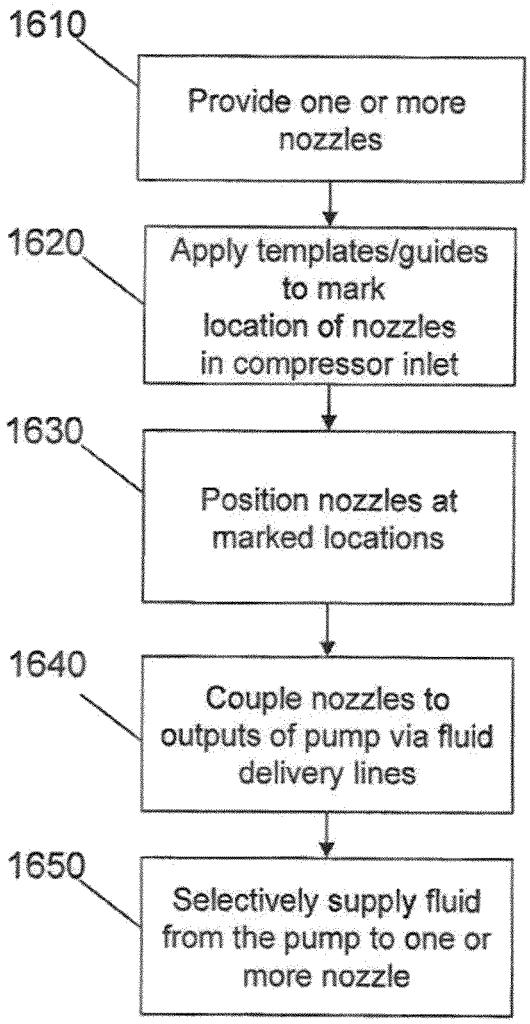
FIG. 16 illustrates a flowchart of a method for washing a compressor, according to an embodiment.

With reference to FIG. 16, a flowchart illustrates a, method for installation of a compressor wash system, such as the compressor wash system 100, for example. At 1610, one or more nozzles, such as nozzles 132 that may be part of a corresponding nozzle set 130 that are part of the compressor wash system 100, are provided. The nozzle sets 130 may be connected to a manifold, such as a bellmouth nozzle manifold 710 or an inlet cone nozzle manifold 720. Each nozzle set may include one or more nozzles 132, each nozzle 132 having a nozzle body 134 and a nozzle spray tip 136 disposed on an end of the nozzle body 134.

At 1620, one or more templates and/or installation guides are applied to a portion of an inlet of the compressor to mark a location for each of the nozzles 132 of the nozzle sets 130. The templates and/or installation guides may be configured to, for example, mark nozzle positions for a bellmouth nozzle. For example, a template may be positioned around the struts 222 of the bellmouth assembly 220 to mark nozzle positions between the struts 222. The nozzle positions may include one nozzle 132 between each strut, although other configurations may be utilized. Other templates and/or installation guides may be configured to mark nozzle positions for an inlet cone nozzle. The corresponding template or guide may fit around bolt holes from existing bolt hole circles, for example.

At 1630, each of the nozzles 132 are positioned either in the ell or inlet cone assemblies in the compressor at the corresponding marked location. The nozzles 132 are oriented to allow for each nozzle spray tip 136 to extend into an inlet air flow path of the compressor within line of sight of the compressor blades.

At 1640, each nozzle set 130, including the one or more nozzles 132, is coupled to an output of a pump via a corresponding fluid delivery line 120. The pump, such as the pump 110 of the compressor wash system 100, is configured to supply fluid through the fluid delivery lines 120 to the nozzle sets 130, from which the fluid is ejected or dispersed into the compressor for washing thereof.

At 1650, fluid is selectively supplied from the pump 110 to one or more nozzle sets 130. The selective supply is based upon a predetermined sequencing pattern that washes a desired portion of the compressor.

The foregoing examples are provided merely for the purpose of explanation and are in no way to be construed as limiting. While reference to various embodiments are shown, the words used herein are words of description and illustration, rather than words of limitation. Further, although reference to particular means, materials, and embodiments are shown, there is no limitation to the particulars disclosed herein. Rather, the embodiments extend to all functionally equivalent structures, methods, and uses, such as are within the scope of the appended claims.

The invention claimed is:

1. A method for washing a compressor, the compressor comprising an inlet and a plurality of blades, the method comprising:

providing a plurality of nozzle sets, each nozzle set comprising one or more nozzles, each nozzle comprising a nozzle body and a nozzle spray tip disposed on an end of the nozzle body;

applying one or more templates or installation tools to an inlet cone or a bellmouth assembly of the compressor inlet and marking a location for each of the one or more nozzles;

positioning one or more nozzles of the plurality of nozzle sets in an opening on the inlet of the compressor at the corresponding marked locations so that each nozzle extends into the inlet air flow path of the compressor and each nozzle is disposed on one of the inlet cone or the bellmouth assembly of the compressor inlet, wherein each of the plurality of nozzle sets comprises a nozzle manifold, each nozzle manifold configured to supply fluid to each nozzle within the corresponding nozzle set, wherein one or more of the plurality of nozzle sets comprises a bellmouth nozzle manifold configured to supply fluid to nozzles positioned on the bellmouth assembly of the compressor inlet, and wherein one or more of the plurality of nozzle sets comprises an inlet cone nozzle manifold configured to supply fluid to nozzles positioned on the inlet cone of the compressor inlet;

coupling each of the nozzle sets to an output of a pump via a corresponding fluid delivery line; and selectively supplying fluid from the pump to one or more of the plurality of nozzle sets positioned on one or more of the inlet cone or the bellmouth assembly.

2. The method of claim 1, further comprising drilling insertion ports in the one or more templates or installation tools at the marked locations to position the nozzles.

3. The method of claim 2, further comprising applying fitting sleeves to each insertion port, wherein the fitting sleeves are configured to hold in position a corresponding nozzle, wherein each nozzle further comprises a lock collar connected to the nozzle body, each lock collar configured to secure the corresponding nozzle in a corresponding fitting sleeve.

4. The method of claim 1, wherein one or more of the applied templates or installation tools fits around struts of a bearing hub to mark nozzle positions between struts of the bellmouth assembly.

5. The method of claim 1, wherein one or more of the applied templates or installation tools fits around an inner circumference of the inlet cone to mark nozzle positions around the circumference.

6. The method of claim 1, further comprising:

installing nozzles on the inlet cone or on the bellmouth assembly of the compressor with a cone installation tool comprising a drill bit guide configured to drill a positioning angle for the nozzle spray tips of the nozzles.

7. The method of claim 1, wherein the one or more templates comprises a one strut template or a two strut template to mark bellmouth nozzle port penetration points for insertion and placement of bellmouth nozzles on the bellmouth assembly, wherein the one strut template is configurable to be positioned around one strut of the bellmouth assembly, and wherein the two strut template is configurable to be positioned around two struts of the bellmouth assembly.

8. A method for washing a compressor, the compressor comprising an inlet and a plurality of blades, the method comprising:

providing a plurality of nozzle sets, each nozzle set comprising a plurality of nozzles, each nozzle comprising a nozzle body and a nozzle spray tip disposed on an end of the nozzle body;

applying one or more templates or installation tools to a portion of an inlet of the compressor and marking a location for each of the plurality of nozzles;

positioning the nozzles of the plurality of nozzle sets in an opening on the inlet of the compressor at the corresponding marked locations so that each nozzle extends into the inlet air flow path of the compressor and each nozzle is disposed on one of an inlet cone or a bellmouth assembly of the compressor inlet, wherein each of the plurality of nozzle sets comprises a nozzle manifold, each nozzle manifold configured to supply fluid to each nozzle within the corresponding nozzle set, wherein one or more of the plurality of nozzle sets comprises a bellmouth nozzle manifold configured to supply fluid to nozzles positioned on the bellmouth assembly of the compressor inlet, and wherein one or more of the plurality of nozzle sets comprises an inlet cone nozzle manifold configured to supply fluid to nozzles positioned on the inlet cone of the compressor inlet;

coupling each of the nozzle sets to an output of a pump via a corresponding fluid delivery line;

providing a plurality of control valves wherein each control valve is connected to one of a corresponding fluid delivery line between the pump and a corresponding nozzle set; and using the control valves to selectively supply fluid from the pump to one or more of the plurality of nozzle sets, wherein the selective supply is based upon a sequencing pattern determined to wash a portion of the compressor blades.

9. The method of claim 8, wherein applying one or more templates and/or installation tools to a portion of an inlet of the compressor comprises positioning one or more templates and/or installation tools on the inlet cone of the compressor or on the bellmouth assembly of the compressor.

10. The method of claim 9, further comprising drilling insertion ports in the one or more templates and/or installation tools at the marked locations to position the nozzles.

11. The method of claim 10, further comprising applying fitting sleeves to each insertion port, wherein the fitting sleeves are configured to hold in position a corresponding nozzle, wherein each nozzle further comprises a lock collar connected to the nozzle body, each lock collar configured to secure the corresponding nozzle in a corresponding fitting sleeve.

12. The method of claim 9, wherein one or more of the applied templates and/or installation tools fits around struts of a bearing hub to mark nozzle positions between struts of the bellmouth assembly.

13. The method of claim 9, wherein one or more of the applied templates and/or installation tools fits around an inner circumference of the inlet cone to mark nozzle positions around the circumference.

14. The method of claim 9, further comprising:

installing nozzles on the inlet cone or on the bellmouth assembly of the compressor with a cone installation tool comprising a drill bit guide configured to drill a positioning angle for the nozzle spray tips of the nozzles.

15. The method of claim 9, wherein the one or more templates comprises a one strut template or a two strut template to mark bellmouth nozzle port penetration points for insertion and placement of bellmouth nozzles on the bellmouth assembly, wherein the one strut template is configurable to be positioned around one strut of the bellmouth assembly, and wherein the two strut template is configurable to be positioned around two struts of the bellmouth assembly.

* * * * *